US006763606B2

(12) United States Patent
Saida

(10) Patent No.: US 6,763,606 B2
(45) Date of Patent: Jul. 20, 2004

(54) APPARATUS FOR APPLYING IONIZED PARTICLES AND METHOD FOR APPLYING IONIZED PARTICLES

(75) Inventor: Itaru Saida, Hikone (JP)

(73) Assignee: Matsushita Electric Works, Ltd. (JP)

( * ) Notice: Subject to any disclaimer, the term of this patent is extended or adjusted under 35 U.S.C. 154(b) by 0 days.

(21) Appl. No.: 10/213,366

(22) Filed: Aug. 9, 2002

(65) Prior Publication Data

US 2003/0033726 A1 Feb. 20, 2003

(30) Foreign Application Priority Data

Aug. 10, 2001 (JP) ..... 2001-244628

(51) Int. Cl.[7] ..... A45D 20/10

(52) U.S. Cl. ..... 34/97; 34/96; 392/380; 392/385

(58) Field of Search ..... 34/96, 97; 392/380, 392/385, 383, 384

(56) References Cited

U.S. PATENT DOCUMENTS 3,745,306 A * 7/1973 Naritomi ..... 392/335
3,794,243 A * 2/1974 Tamny et al. ..... 239/3
5,805,406 A * 9/1998 Mailand ..... 361/212
6,067,724 A * 5/2000 Depoyian ..... 34/97
6,191,930 B1 * 2/2001 Ramchandani ..... 361/213
6,640,049 B1 * 10/2003 Lee et al. ..... 392/385

FOREIGN PATENT DOCUMENTS

JP 8-47415 2/1996 ..... A45D/20/12
JP 9-350 1/1997 ..... A46B/15/00

* cited by examiner

*Primary Examiner*—Ira S. Lazarus
*Assistant Examiner*—Kathryn S. O'Malley
(74) *Attorney, Agent, or Firm*—Osha & May L.L.P.

(57) ABSTRACT

An apparatus for applying ionized particles is disclosed. The apparatus includes an ionized particle emitter for emitting ionized particles against an object; and an electric potential maintainer for maintaining electric potential of the object at a predetermined level such that the ionized particles emitted against the object by the ionized particle emitter are continuously attracted to the object while the electric potential is maintained. A method for applying ionized particles is also disclosed. The method includes emitting ionized particles against an object, and maintaining electric potential of the object at a predetermined level such that the ionized particles are continuously attracted to the object.

6 Claims, 19 Drawing Sheets

APPARATUS FOR APPLYING IONIZED PARTICLES AND METHOD FOR APPLYING IONIZED PARTICLES

BACKGROUND OF INVENTION

Recently, hairdryers, hairbrushes, etc., with functions to expel ionized particles (negatively ionized air or positively ionized air) have enjoyed increasing popularity. These devices make it possible to obtain the effect of treating the hair, making it more manageable and giving it more body, by expelling towards the hair negatively ionized air or positively ionized air while drying the hair or brushing the hair.

In conventional hairdryers, etc., of the type described above, the effect of expelling negatively ionized air or positively ionized air at an object has been to create a static charge in the object due to the ionized particles expelled. The build up of this static charge presents a problem in that it prevents the treatment, described above, from being fully effective. For example, as shown in FIG. 24, when an object 3 becomes positively charged and negatively ionized particles generated by an ionized particle generator 2 strike the object 3, the positive charges that have accumulated in the object 3 are neutralized by the negatively ionized particles 1, reducing the electric potential V1 as shown in FIG. 25. After this, when the object 3 goes to a negative electric potential, the ionized particles 1 and the object 3 both have the same polarity, and thus repel each other, preventing the adsorption of the ionized particles. When, as is shown in FIG. 26, a negative charge has accumulated on the object 3, the electric potential V2 of the object 3 is the same as that of the ionized particles (as shown in FIG. 27), so they repel each other, preventing adsorption. As shown in FIGS. 28 through 31, when positively ionized particles are used as the ionized particles 1, the electric potential V3 of the object 3 and the electric potential of the charged particle 1 are both reversed, and so, similarly, as time passes the electric potential V4 of the object 3 (FIG. 31) goes to the same polarity as the ionized particles 1, causing the ionized particles 1 and the object 3 to repel each other, preventing the ionized particles 1 from adsorbing. The result is that it has been difficult to cause the ionized particles 1 generated by the ionized particle generator 2 to be adsorbed continuously by the object 3.

The present invention provides an ion application device and ion application method that is able to apply ionized particles continuously, able to cause a greater number of ionized particles to be attracted to the object, and able to cause these ionized particles to be adsorbed continuously by the object.

SUMMARY OF INVENTION

In general, in one aspect, the present invention relates to an apparatus for applying ionized particles. The apparatus comprises an ionized particle emitter for emitting generating ionized particles against an object, and an electric potential maintainer for maintaining electric potential of the object at a predetermined level such that the ionized particles emitted against the object by the ionized particle emitter are continuously attracted to the object while the electric potential is maintained.

In general, in one aspect, the present invention relates to a method for applying ionized particles. The method comprises emitting ionized particles against the object, and maintaining electric potential of an object at a predetermined level such that the ionized particles are continuously attracted to the object while the electric potential is maintained.

In general, in one aspect, the present invention relates to a hairdryer. The hairdryer comprises a housing body having an air intake opening and an air outlet opening, an air ionizing device disposed within the housing body for generating ionized air, a fan disposed within the housing body for introducing air into the housing body through the air intake opening and directing the air to the air ionizing device such that the air containing ionized air is discharged through the air outlet opening, a handle attached to the housing body, and a voltage generator attached to the hairdryer for generating voltage of a predetermined level. The voltage generator is electrically connected to the handle such that electric potential of a user grasping the handle is maintained at the predetermined level.

In general, in one aspect, the present invention relates to a hair brush. The hairbrush comprises a main body having a grip portion and a brush portion. The grip portion is provided with an air intake opening and the brush portion is provided with an air outlet opening. The hairdryer further comprises an air ionizing device disposed within the main body for generating ionized air, a fan disposed within the main body for introducing air into the main body through the air intake opening and directing the air to the air ionizing device such that the air containing ionized air is discharged through the air outlet opening; and a voltage generator disposed within the main body for generating voltage of a predetermined level. The voltage generator is electrically connected to the grip portion of the main body such that electric potential of a user grasping the grip portion of the main body is maintained at the predetermined level.

In general, in one aspect, the present invention relates to a steam applicator. The steam applicator comprises a housing body having a steam outlet opening, a steam generator disposed in the housing body for generating steam, an air ionizing device disposed within the housing body for generating ionized air, a fan disposed within the housing body for expelling steam generated by the steam generator toward the air ionizing device such that the steam containing ionized air is discharged through the steam outlet opening, a voltage generator disposed in the housing body for generating a predetermined voltage; and a grip member connected to the housing body via a cable line. The grip member is electrically connected to the voltage generator such that electric potential of a user grasping the grip member is maintained at a predetermined level.

Other aspects and advantages of the invention will be apparent from the following description and the appended claims.

DETAILED DESCRIPTION

In one aspect, the present invention relates to an apparatus and method for applying ionized particles to a body. In a first embodiment, ionized particles 1 are blown against a body surface (skin, hair, etc.) to produce the effect of a process for beauty, therapy, etc.

Figure 1:
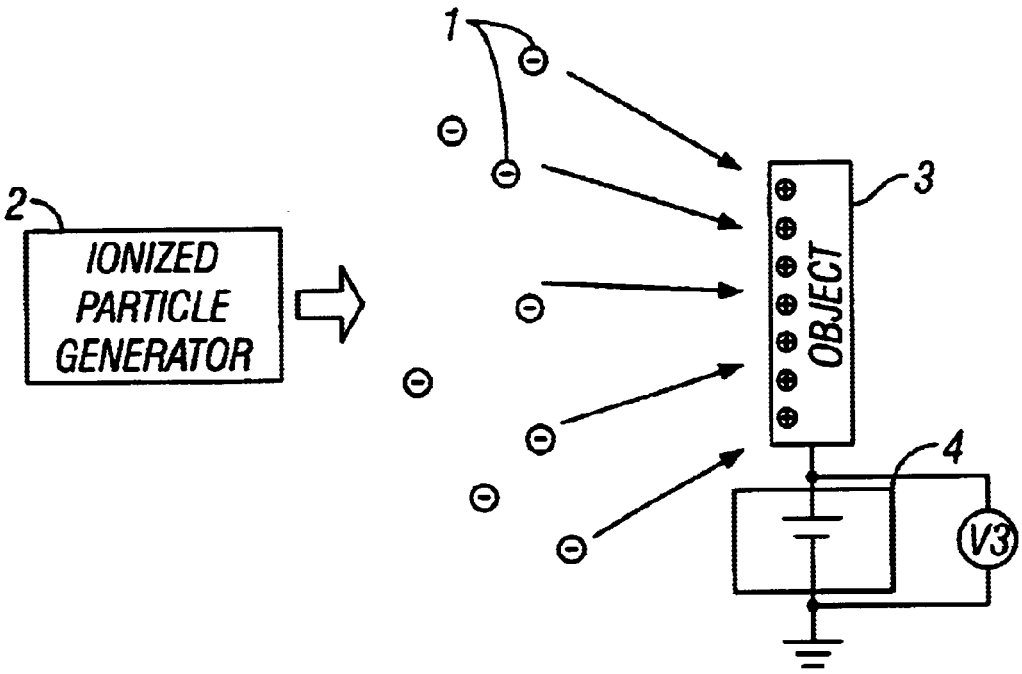
FIG. 1 is a schematic drawing showing one embodiment of the apparatus for applying ionized particles of the present invention, where the ionized particles are negatively charged air ions and the object is maintained at a positive electric potential.

FIG. 1 is a schematic drawing showing an apparatus for applying ionized particles according to one embodiment of the present invention. This device comprises a ionized particle generator 2 that blows ionized particles 1 in the direction of an object 3, and a means for maintaining electric potential 4 that maintains the electrical potential of the object 3 so that the ionized particles 1 will be continuously attracted to and adsorbed by the object 3. In the present example, the object 3 is a human body.

Figure 5:
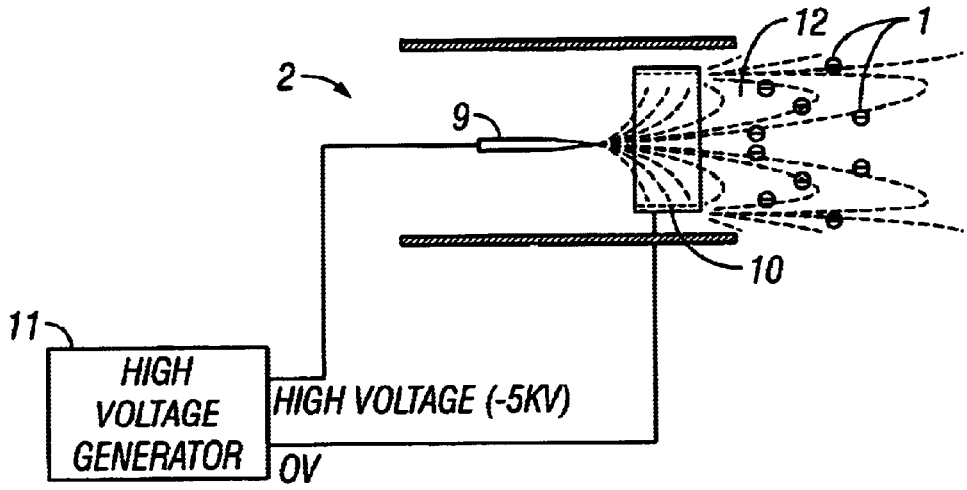
FIG. 5 is a schematic drawing that illustrates a mechanism that generates the negatively ionized air in the ionized particle generator.

As is shown in detail in FIG. 5, the ionized particle generator 2 generates ionized air (negatively ionized air or positively ionized air) as ionized particles 1 through, for example, corona discharge. Specifically, the ionized particle generator 2 comprises a needle-shaped discharge electrode 9, a ground electrode 10, and a high voltage generator 11 for generating the ionized particles 1 through a corona discharge by applying a high-voltage alternating current between the electrodes 9 and 10. An ionized particle blower 12 is equipped on the line extending from the needle-shaped discharge electrode 9 to the ground electrode 10. In this particular embodiment, the needle-shaped discharge electrode 9 is structured in the shape of a needle with a metal rod that is sharp on the tip. The ground electrode 10 comprises a metal plate, and is equipped at an angle in front of the needle-shaped discharge electrode. The high voltage generator 11 is connected on the reference voltage side to the ground electrode 10, and on the high-voltage side to the needle-shaped discharge electrode 9. If negatively ionized air is to be generated, a voltage of, for example, 5 kV DC is outputted, and if positively ionized air is to be generated, a voltage of, for example, +5 kV DC is outputted. Note that the ionized particle generator 2 is not limited to generating either negatively ionized air or positively ionized air through a corona discharge as described above, but, for example, two high voltage generation devices can be used together to selectively generate both positively and negatively ionized air.

As is seen in FIG. 1, a means for maintaining electric potential 4 that maintains the electric potential V3 (shown in FIGS. 2 and 4) of the object is connected to the object 3. As is shown in FIG. 9(*b*), the means for maintaining electric potential 4 is structured from a positive voltage generator circuit 7*a* when the charge on the ionized particles 1 is negative, and structured from a negative voltage generator circuit 7*b* when the charge of the ionized particles is positive.

Figure 8:
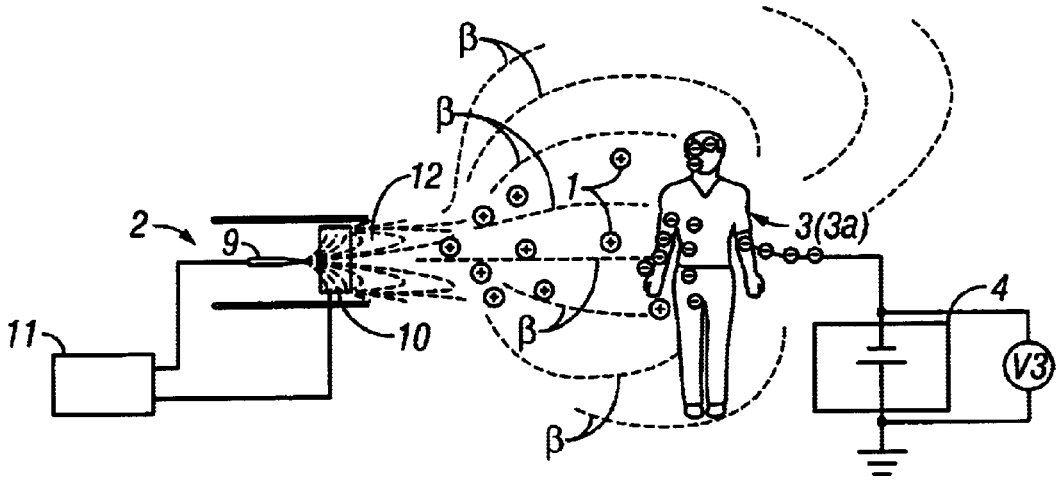
FIG. 8 is a schematic illustrating a case where the positively ionized air, as described above, is attracted to and adsorbed by the object.
Figure 9A:
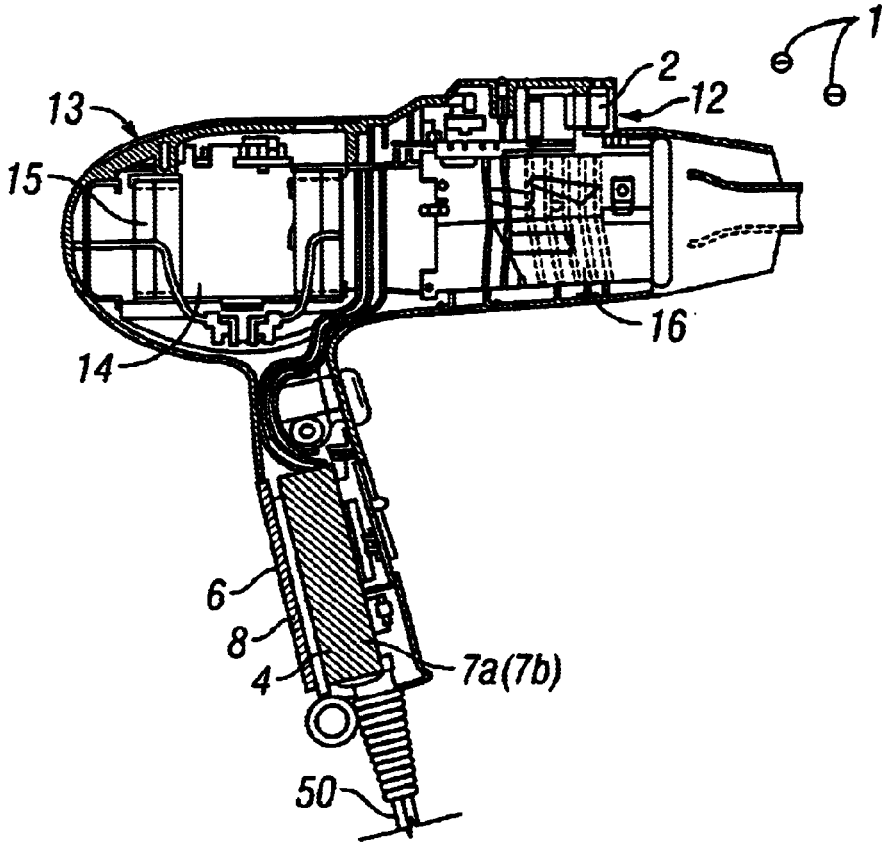
FIG. 9(*a*) is a cross-sectional drawing where an apparatus for applying ionized particles is incorporated into a hair dryer, and FIG. 9(*b*) is an explanatory diagram of the contacts between the voltage generator circuit and the insulator from which the grip member is structured.
Figure 9B:
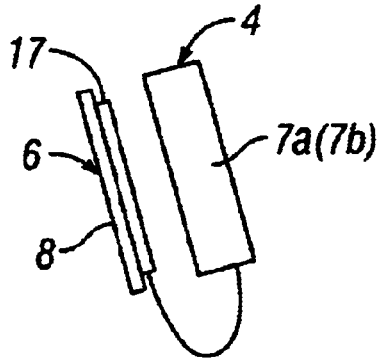

FIG. 9(*a*) shows a hair dryer that incorporates the ionized particle generator 2 and the means for maintaining electric potential 4. The hair dryer 13 is provided with a grip member 6 by which the user can grip the hair dryer, a motor 14, a fan 15, and a heater 16, along with an ionized particle blower 12. In the present embodiment, the grip member 6 comprises a grip-shaped insulator 8 (a fabricated product) where, as shown in FIG. 9(*b*), an electrically conductive tape 17, such as an aluminum tape, is affixed to the back surface of the insulator 8. A positive voltage generator circuit 7*a* is equipped as the means for maintaining electric potential 4, housed in the grip member 6, if the charge in the ionized particles 1 from the ionized particle generator 2 is negative, and a negative voltage generator circuit 7*b* is equipped as the means for maintaining electric potential 4, housed in the grip member 6, if the charge on the ionized particles 1 is positive. As is shown in FIG. 9(*b*), the output terminal of this voltage generation circuit 7*a* (or 7*b*) is connected through a connecting wire to the electrically conductive tape 17, and when the hair dryer 13 is used, the user grasps the grip member 6 with a hand, which charges the entire human body 3*a* (FIG. 8) positively (or negatively).

Figure 2:
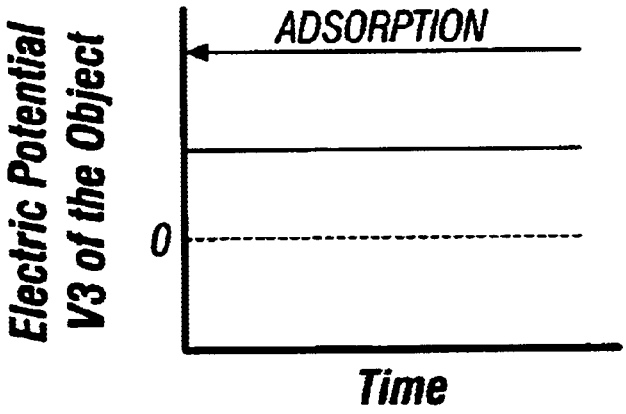
FIG. 2 is a graph showing the electric potential of the object in FIG. 1 as a function of time.
Figure 3:
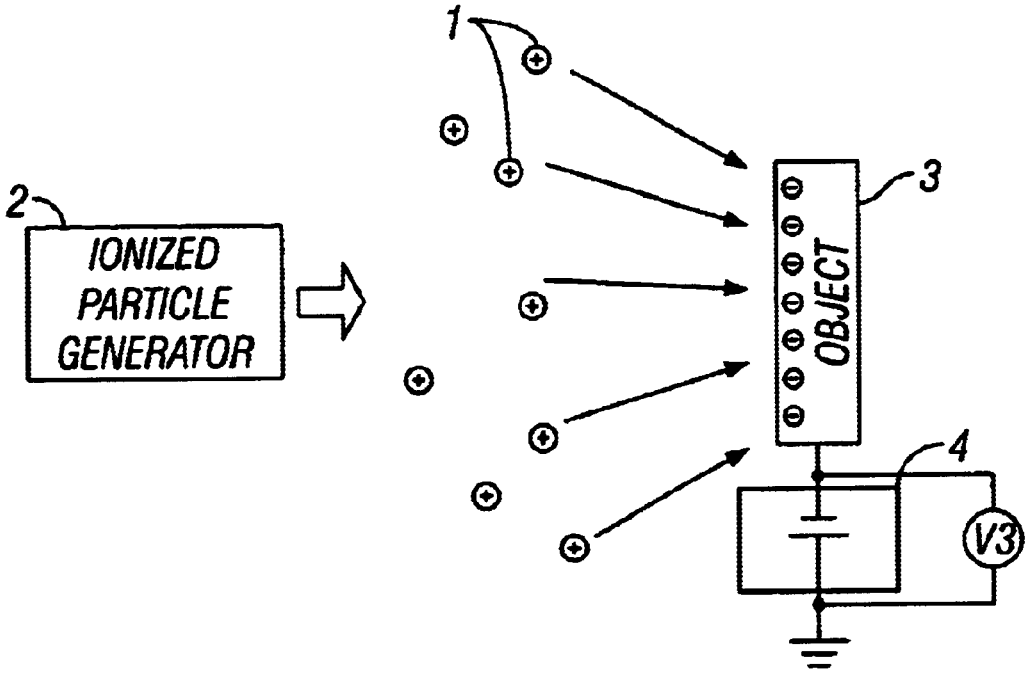
FIG. 3 is a schematic illustrating the interaction of positively ionized air and an object held at a negative electric potential.
Figure 6:
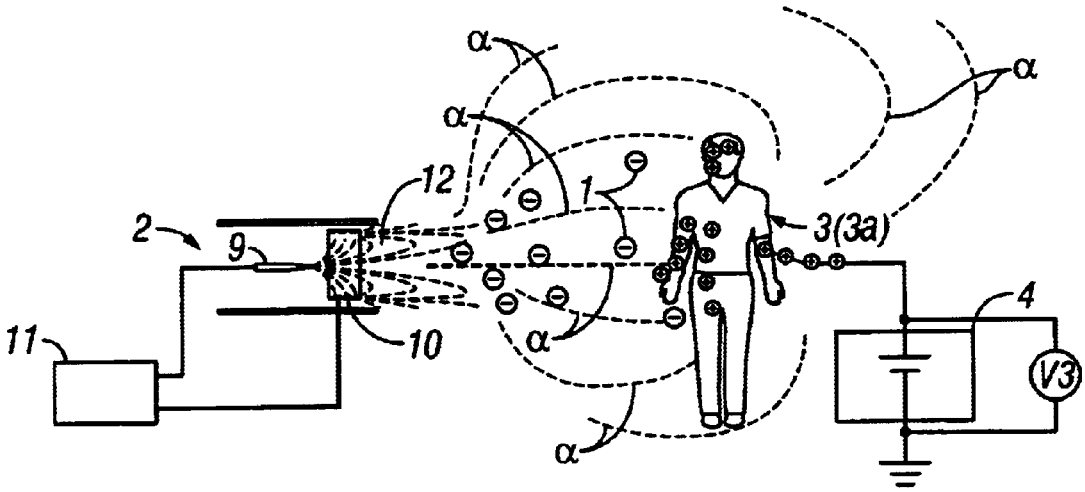
FIG. 6 is a schematic illustrating an embodiment in accordance with the present invention.

As is shown in FIG. 6, when the ionized particle generator 2 is caused to generate negatively ionized air, a positive voltage generator circuit is used as the means for maintaining electric potential 4. Specifically, as is shown in FIG. 5, a voltage of, for example, 5 kV DC is applied to the needle-shaped discharge electrode 9, from the high voltage generation device 11, relative to the ground electrode 10 as a reference. Because the tip of the needle-shaped discharge electrode 9 is pointed, it concentrates the electric field to generate a corona discharge in the vicinity of the tip of the needle-shaped discharge electrode 9, while, at the same time, producing negatively ionized air. When the grip member 6 of the hair dryer 13 (FIG. 9) is grasped in the hand at this time, the entire human body 3*a* (hair, scalp, skin, etc.) becomes positively charged. As is shown by α in FIG. 6, this forms an electric power beam pointing towards the human body 3*a*, causing the negatively ionized air to move along the electric power beam, to be attracted to and adsorbed by the human body 3*a* (the hair). After adsorption, the charge from the ionized particles 1 flows to the outside through the positive voltage generator circuit, and thus, as shown in FIG. 2, the voltage V3, to which the human body 3*a* was charged, is maintained as is, making it possible for the ionized particles 1 to continue to strike the human body 3*a*. Here the ionized particles 1 are a substance wherein charge is attached to particles, so when the ionized particles 1 continue to be adsorbed by the surface of the human body 3, the substance that comprises the ionized particles 1 operates on (is adsorbed by) the human body 3*a*.

Figure 4:
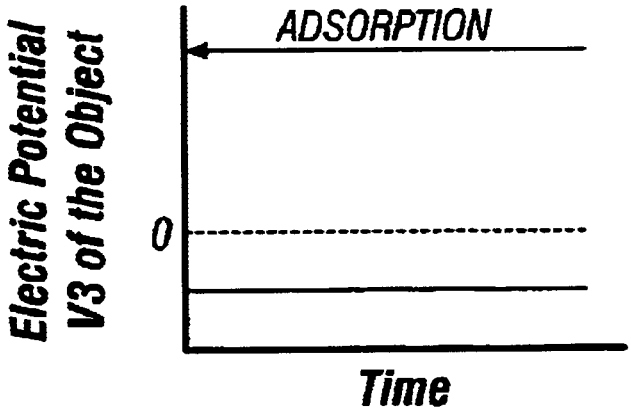
FIG. 4 is a graph showing the electric potential of the object in FIG. 3 as a function of time.
Figure 7:
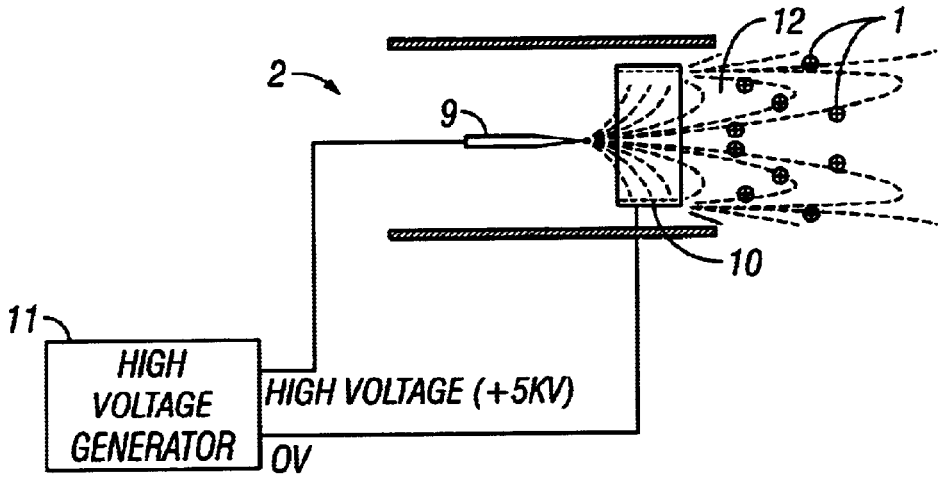
FIG. 7 is a schematic illustrating a mechanism by which positively ionized air is generated by the ionized particle generator.

When positively ionized air is produced by the ionized particle generator 2, a negative voltage generation circuit is used as the means for maintaining electric potential 4, as shown in FIG. 8, and, as shown in FIG. 7, a voltage such as, for example, +5 kV DC relative to the ground electrode 10 is applied by the high voltage generation device 11 to the needle-shaped discharge electrode 9. This not only generates positively ionized air, but also negatively charges the human body 3*a*, and creates an electric power beam pointed towards the human body 3*a*, and, as shown in β in FIG. 8, causes the ionized particles 1 to move along the electric power beam to be attracted to and adsorbed by the human body 3*a*. At this time, the voltage V3 to which the human body 3*a* is charged will be maintained as it is, as shown in FIG. 4, making it possible for the ionized particles 1 to continue to strike the human body 3*a*.

The result of this is not only that the ionized particles 1 are emitted towards the human body 3*a*, but that a greater number of the ionized particles 1 are attracted to the human body 3*a*, while also making it possible to continuously adsorb the same.

In the present example, the charged particle 1 are generated by a corona discharge, making it possible to produce a greater amount of the negatively ionized air or the positively ionized air, with more than 1 million particles per cubic centimeter. This makes it possible for the human body 3*a* to attract a greater number of ionized particles 1 and also to adsorb the same more continuously, with the result that, when the object is human hair, a greater number of negatively ionized air particles will be adsorbed, making the hair more manageable and giving it more body. On the other hand, were no means provided for maintaining electric potential, the effect of greater manageability and body in the hair would be limited; however, the provision of the means for maintaining electric potential 4 makes it possible to continuously bombard the human body 3*a* (hair) with the negatively ionized air, thereby increasing substantially the effects of making the hair manageable and giving the hair body.

The means for maintaining electric potential 4 in the present embodiment uses a positive voltage generator circuit if the charge on the ionized particles 1 is negative, and uses a negative voltage generator circuit if the charge on the ionized particles 1 is positive, and thus grasping the grip member 6 in the hand when using the hair dryer 13 easily charges the hand and, at the same time, easily charges the entire human body 3*a* (hair, scalp, skin, etc.) to a positive (or negative) electric potential. The use of the voltage generation circuits not only causes the emission of ionized particles 1 towards the human body 3*a*, but can also cause the human body 3*a* to attract a greater number of the ionized particles 1, while adding a simple function that makes it possible to continuously adsorb the ionized particles. Furthermore, the use of the positive voltage generation circuit or the negative voltage generation circuit makes it possible to attract a greater number of the ionized particles 1, and possible to adsorb the same continuously, through the maintenance an electric potential with a polarity that is opposite of the charges on the ionized particles 1 of the object 3.

In this exemplary embodiment, the grip member 6 (FIG. 9) of the hair dryer 13 comprises a grip-shaped insulator 8 (a fabricated product) where an electrically conductive tape 17, connected to the voltage generator circuit inside of the grip member 6, is adhered to the back surface of the insulator 8, so as to eliminate the danger of shock, electrical leakage, etc., when charging the human body by grasping the grip member 6 with the hand when using the hair dryer 13.

In the hair dryer 13 according to the present embodiment, the voltage generator circuit that comprises the voltage maintenance means 4 and the ionized particle generator 2 are wired with a single power supply cord 50 (FIG. 9) and so the wiring that connects the voltage generator circuit and the wiring that connects the ionized particle generator 2 are a single shared power supply cord 50, where the voltage generator circuit and the ionized particle generator 2 can be operated by power supplied from the same power supply. The result is that the wiring can be simplified easily. This is also true for the hairbrush 20, the skin care device 21, and the infuser 26, to be described below.

Note that the means for maintaining electric potential 4 need not be limited to only a single voltage generator circuit, but can comprise two voltage generator circuits (both a positive voltage generator circuit 7*a* and a negative voltage generator circuit 7*b*) where, by switching the output between the two voltage generator circuits, the charge on the ionized particles 1 and the opposite-polarity electric potential can be turned on and off.

Figure 10A:
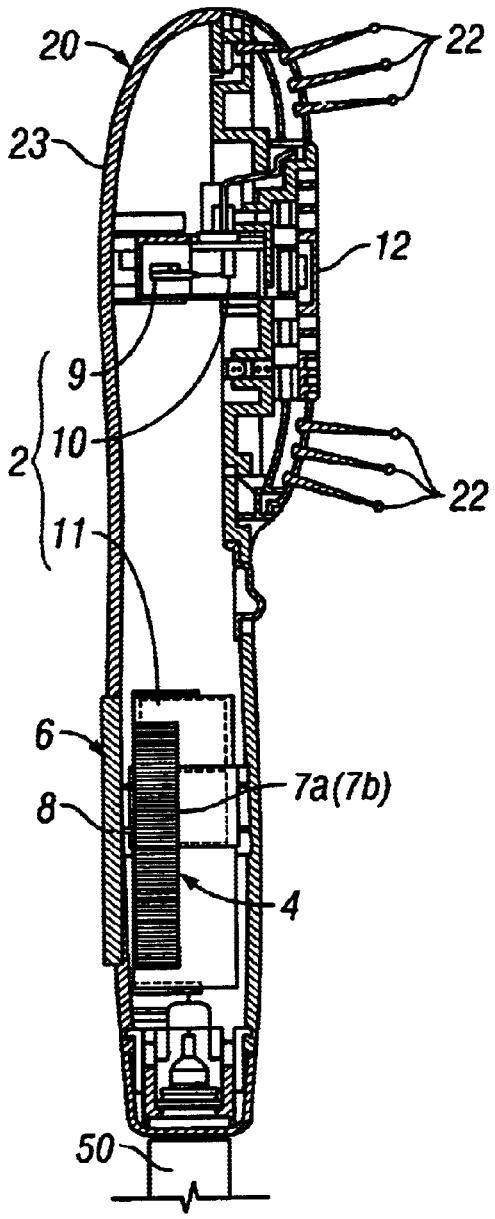
FIG. 10(*a*) is a cross-sectional drawing where an apparatus for applying ionized particles is incorporated into a hairbrush, and FIG. 10(*b*) is an orthonormal view of the same.
Figure 10B:
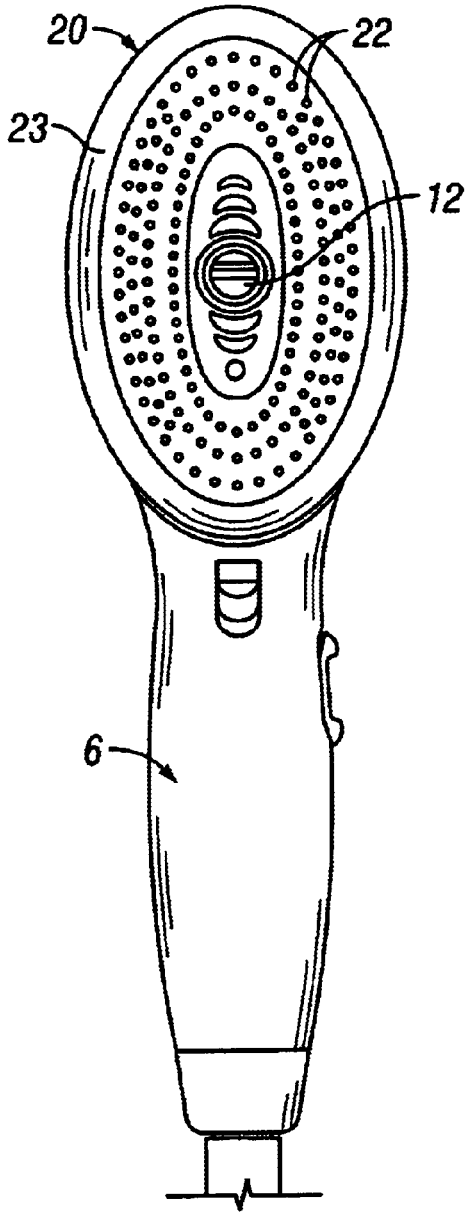

FIGS. 10(*a*) and (*b*) show an example of embodiment of a hairbrush 20 incorporating an ionized particle generator 2 and means for maintaining electric potential 4. The hairbrush 20 comprises a brush portion 22 and a main body 23. The structures of the ionized particle generator 2, the means for maintaining electric potential 4, and the structure of the grip member 6, are, in this embodiment, the same as in the example embodiment of the hair dryer. In the present example, the needle-shaped discharge electrode 9 and the ground electrode 10 are disposed facing the ionized particle blower 12, which is equipped at the front surface of the brush portion 22, and a high voltage generator 11 is equipped inside of the grip member 6. If the means for maintaining electric potential were not provided, even if there were an ionized particle blower, the effects on the manageability and body of the hair would be limited; however, the provision of the means for maintaining electric potential 4 makes the hair substantially more manageable and gives it more body. This is thought to be because the means for maintaining electric potential 4 causes the entire human body 3*a* (hair, scalp, skin, etc.) to maintain an electric potential that is of the opposite polarity to the ionized particles 1, which causes the ionized air (negatively ionized air or positively ionized air) produced by the ionized particle generator 2 to strike the hair continuously. By adding a means for maintaining electric potential 4 in this way, a function is added that emits the ionized particles 1 from the hairbrush towards the object 3, which can add a function that is able to attract more of the ionized particles 1 to the human body, and which is able to cause them to be adsorbed continuously.

Figure 12A:
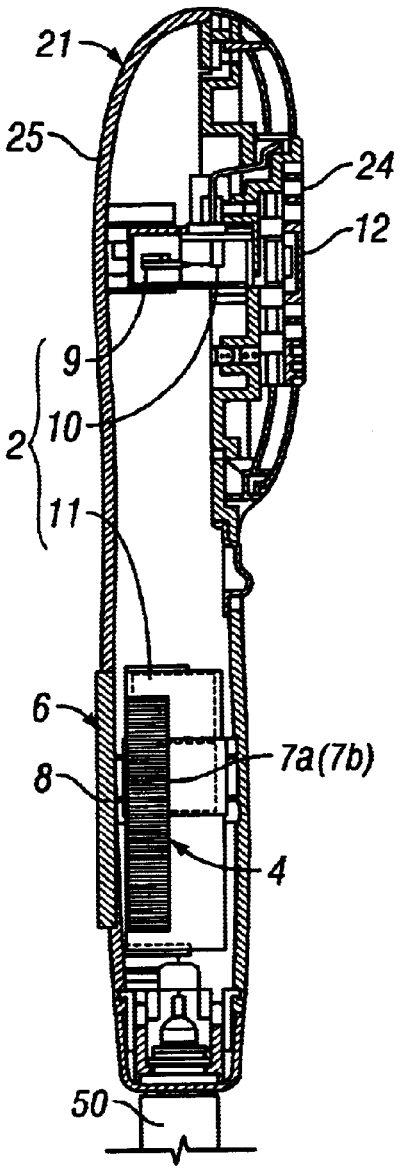
FIG. 12(*a*) shows a cross-sectional drawing where an apparatus for applying ionized particles is incorporated into a skin care device, and FIG. 12(*b*) is an orthonormal view of the same.
Figure 12B:
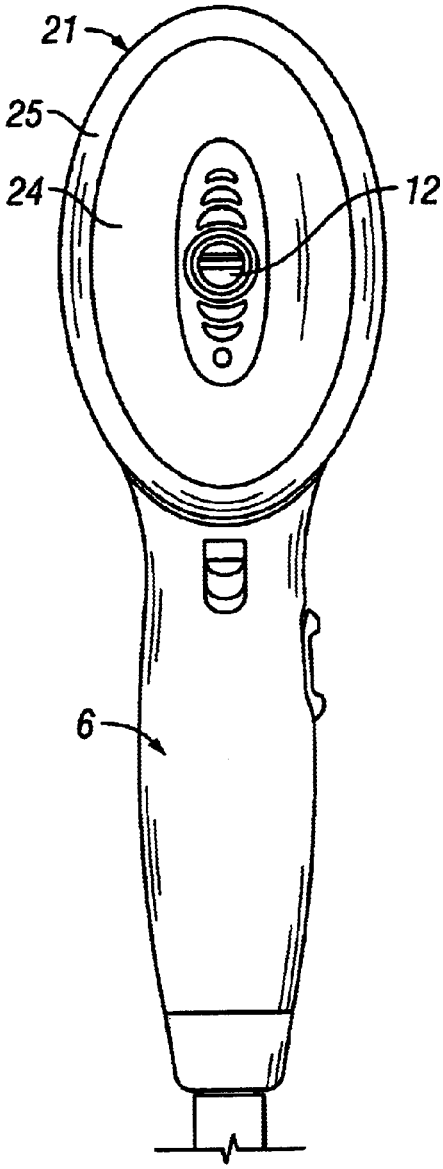

FIGS. 12(*a*) and (*b*) show an example of embodiment of a skin care device 21 that incorporates the ionized particle generator 2 of the present invention and the aforementioned means for maintaining electric potential 4. In the present example, the skin care device 21 comprises a skin contact part 24, which has an ionized particle blower 12, and a grip member 6, which has a main body 25. The skin contact part 24 is structured as a smooth flat surface for contacting the scalp or the skin, etc., and is equipped at its center with an ionized particle blower 12. The structure of the ionized particle generator 2 and the means for maintaining electric potential 4, and the structure of the grip member 6, are the same as in the examples of embodiment described above. When a positive voltage generator circuit is used as the means for maintaining electric potential 4, then when the grip member 6 is grasped and the skin contact part 24 is put in contact with the scalp when using the skin care device 21, the hand becomes positively charged and, at the same time, the entire human body 3*a* (the hair, the scalp, the skin, etc.) becomes positively charged, thereby causing the negatively ionized air generated by the ionized particle generator 2 to strike the scalp continuously. At this time, the scalp is charged positively so that a greater number of the ionized particles 1 are attracted to the scalp, making it possible to cause the ionized particles 1 to adsorb continuously thereto. In particular, when the ionized particles are negative, causing a greater number of negative ions to be adsorbed by the scalp activates the scalp and activates hair growth, increasing the hair growth effect. Of course, in addition to the scalp, the skin care device 21 can also be used on the face or on other skin.

Figure 21A:
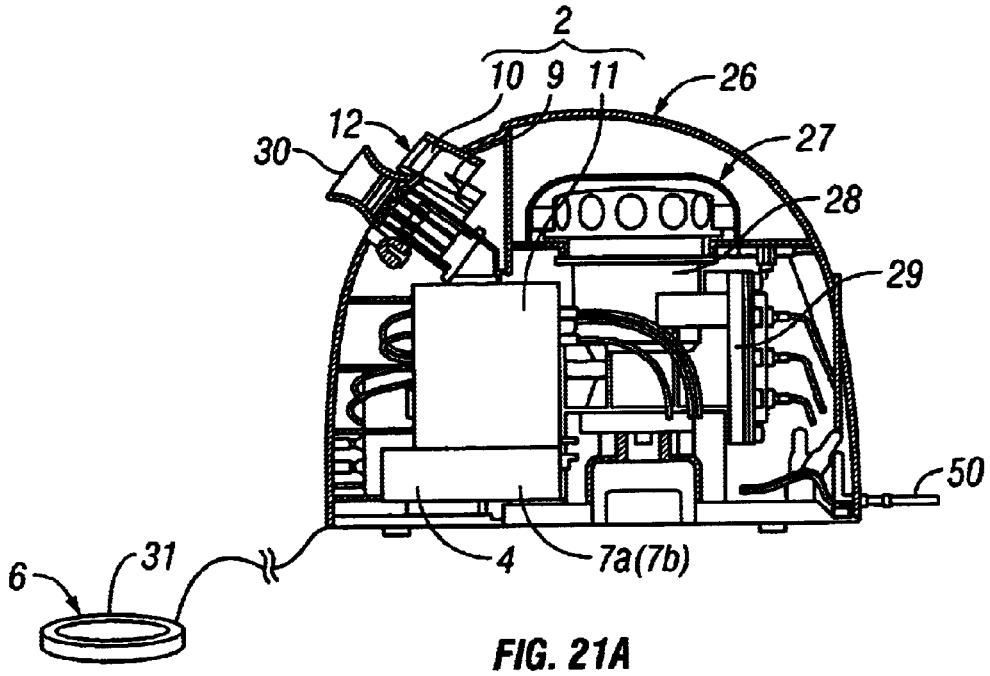
FIG. 21(*a*) is a cross-sectional drawing illustrating an infuser equipped in an apparatus in accordance with an embodiment of the present invention, and FIG. 21(*b*) is the side view of the same.
Figure 21B:
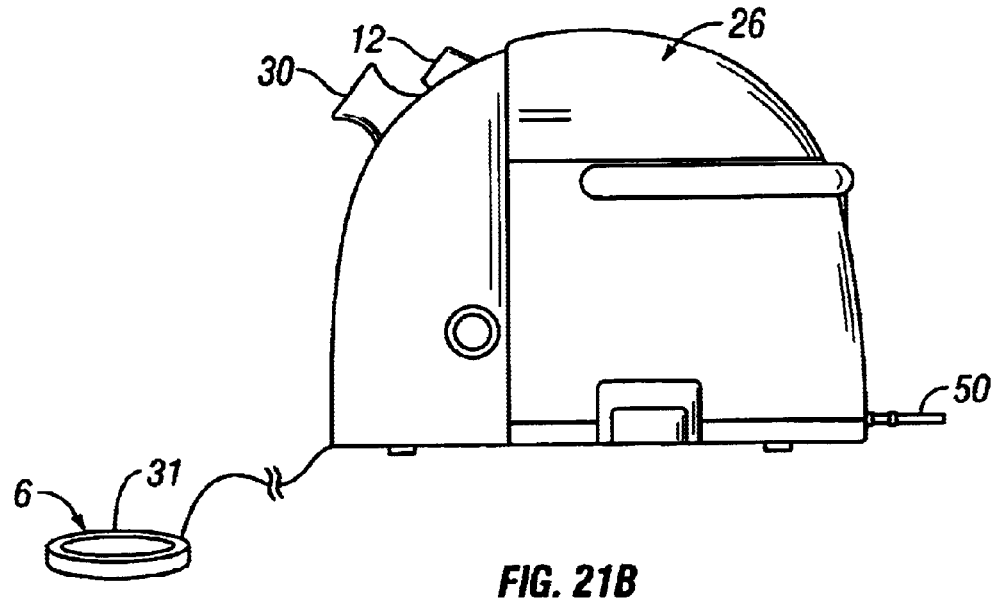

FIGS. 21(*a*) and (*b*) show an infuser as one example of embodiment of a steam generator device 27 that incorporates the ionized particle generator 2 of the present invention and the aforementioned means for maintaining electric potential 4. In the steam generator device 27, water is stored in advance in a tank 28 and is heated by a heater 29. The heated water turns to steam, and is expelled to the outside from a steam outlet opening 30. When this steam comes in contact with the skin, the moisture content of the skin is increased, which can provide the skin with gentle moisture. Inside the infuser 26 there is a means for maintaining electric potential 4, which maintains the electric potential of the object 3, and a ionized particle generator 2. The structures of the ionized particle generator 2 and the means for maintaining electric potential 4 are the same as in the embodiments described above.

A connector part 31 to provide the functions of a grip member 6, to be grasped by the user, is disposed on the outside of the infuser 26. This connector part 31 connects through a connector wire to the voltage generator circuit that comprises the means for maintaining electric potential 34. The voltage generator circuit uses a positive voltage generator circuit 7*a* if the charge on the ionized particles 1 is negative, and uses a negative voltage generator circuit 7*b* if the charge on the ionized particles 1 is positive. An ionized particle blower 12 is disposed in the vicinity of the steam outlet opening 30, and the ionized particles 1 are blown out at the same time as the spray of the steam from the steam outlet opening 30.

When a positive voltage generation circuit is used when using the infuser 26, the steam outlet opening 30 is placed against the skin, and when the hand grasps the contact part 31, the hand becomes charged positively and, at the same time, the entire human body 3*a* (including the skin) becomes charged positively. When the human body 3*a* is positively charged, the negatively ionized air is expelled from the ionized particle blower 12, at which time the skin attracts and adsorbs the negatively ionized air, making it possible for the negatively ionized air to continuously contact the skin. When the negatively ionized air is applied to the skin wherein the moisture content has been increased by the steam from the steam generator device 27, it is possible to obtain an effect where the skin holds the moisture so that the effects on the skin of being moist and smooth will be enduring. The steam may also be provided into the oral cavity, in which case an effect can be obtained wherein the moisture content of the mucus membrane can be increased, especially when the ionized particles 1 comprise negatively ionized air, by applying a large amount of negatively ionized air to the mucus membrane, etc., in the throat. In other words, it is possible not only to add the expulsion of ionized particles 1 at the object 3 to the functions of the steam generator device 27, but to add functions that make it possible to attract and continuously adsorb a greater number of the ionized particles 1 as well.

Figure 13:
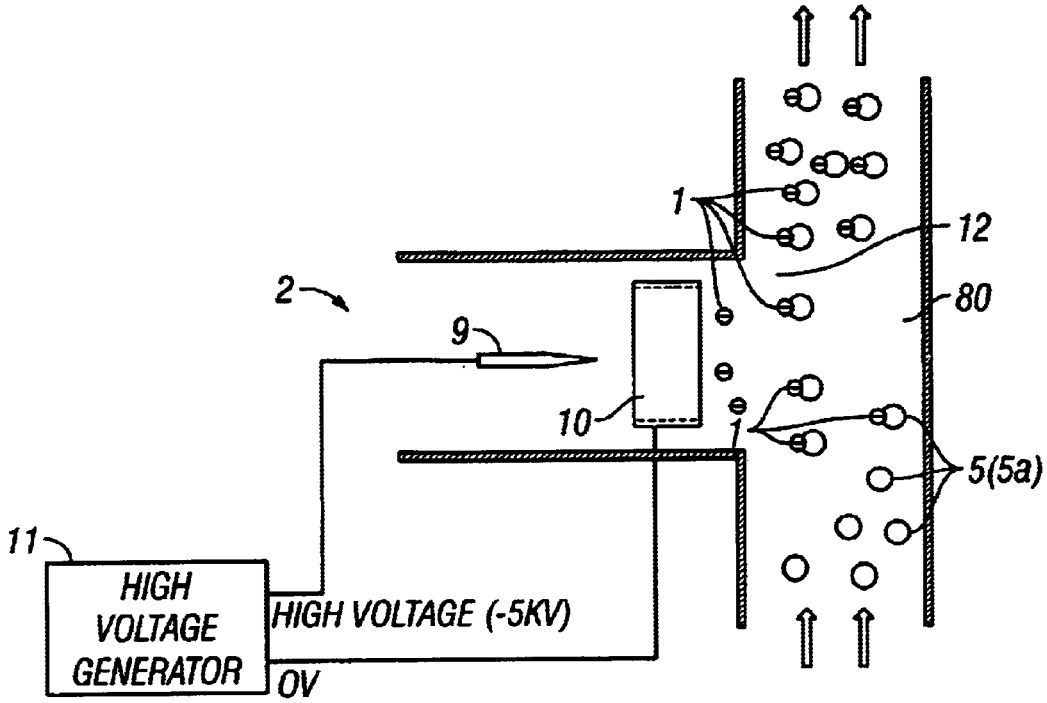
FIG. 13 shows a schematic drawing wherein negatively ionized air is applied to other particles.
Figure 14:
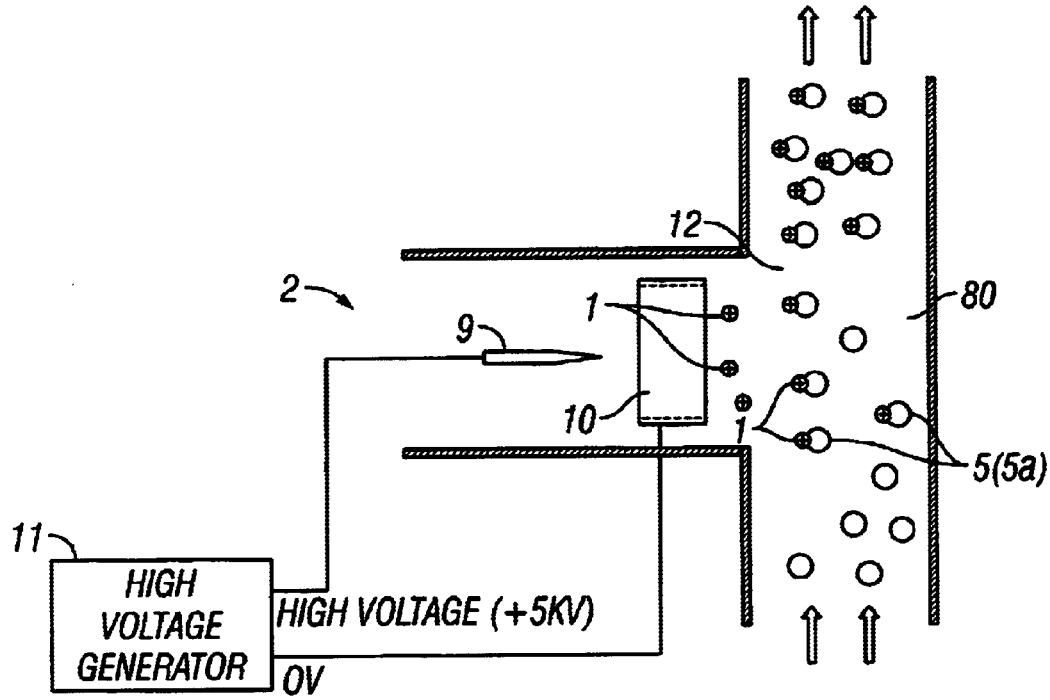
FIG. 14 shows a schematic diagram wherein positively ionized air is applied to other particles.

FIGS. 13 and 14 show another example of the charge particle generator 2 used in embodiments of the present invention. In the present embodiment, the negatively ionized air or positively ionized air, (ionized particles 1), generated by electrical discharge, adheres to other particles 5 to form combined particles.

Figure 15:
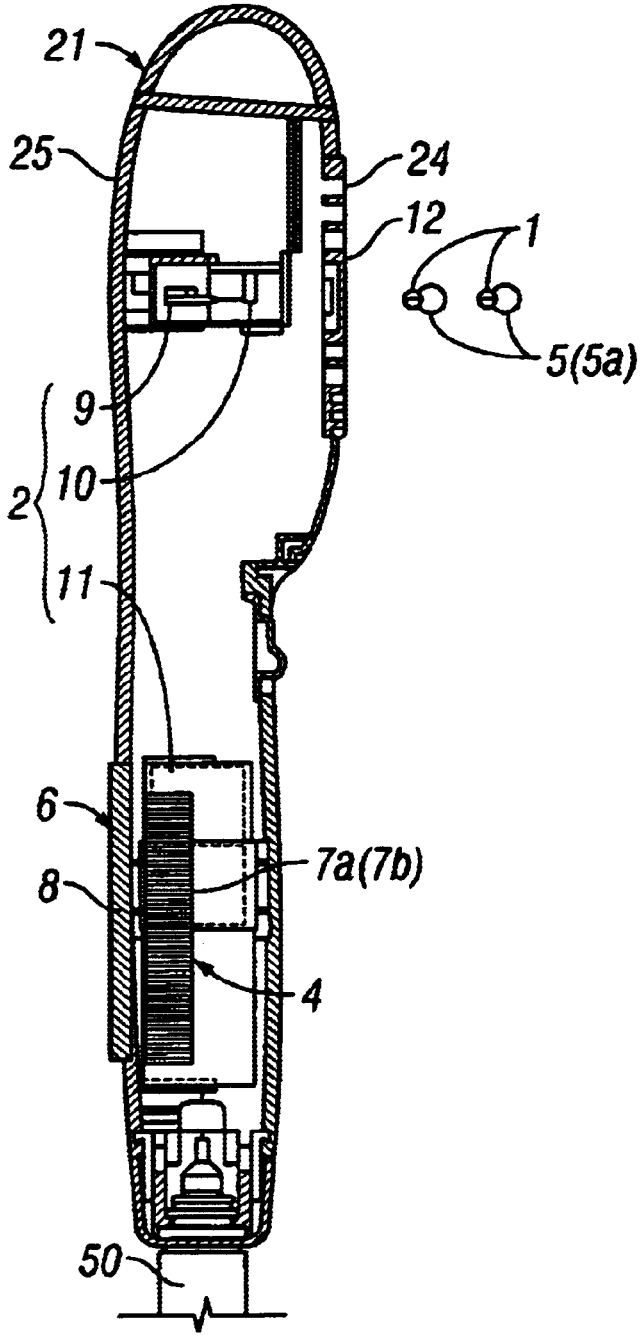
FIG. 15 is schematic diagram showing one embodiment of the present invention.

FIG. 15 shows a skin care device 2 that incorporates the aforementioned ionized particle generator 2. This skin care device 21 is equipped with, for example, a tank that contains a perfuming agent or deodorizing agent, a vaporizer that vaporizes the perfuming agent or deodorizing agent, and an outlet opening that sprays to the outside the vaporized perfuming agent or deodorizing agent in the form of a mist (not shown in the figure). An ionized particle blower 12 is disposed in the vicinity of the outlet opening for the perfuming agent or deodorizing agent mist. A flow path 80 for the particles 5*a* (FIGS. 13 and 14) is provided at the ionized particle blower 12, where the bombardment of the particles 5*a* by the ionized air generates combined particles that combine the ionized particles 1, generated by the electrical discharge, and the particles 5*a*. Although perfuming agents and deodorizing agents are used as examples of the particles 5*a*, the present invention is not limited thereto. Cosmetic agents may also be used in the skin care device 21.

Compound particles wherein the ionized particles 1 attach to the particles 5*a* can be generated by bombarding the vaporized particles 5*a* of the perfuming agent or deodorizing agent with the ionized particles 1 (negatively ionized air in FIG. 13 or positively ionized air in FIG. 14) generated by the corona discharge, at which time a perfuming or deodorizing effect can be obtained as the effect of the perfuming agent or deodorizing agent when the perfuming agent or deodorizing agent is adsorbed by the human body 3*a*. Furthermore, other materials aside from perfuming agents or deodorizing agents may also be used as the particles 5, making it possible for a large number of varied particles to be attracted to and continuously adsorbed by the object 3.

Figure 16:
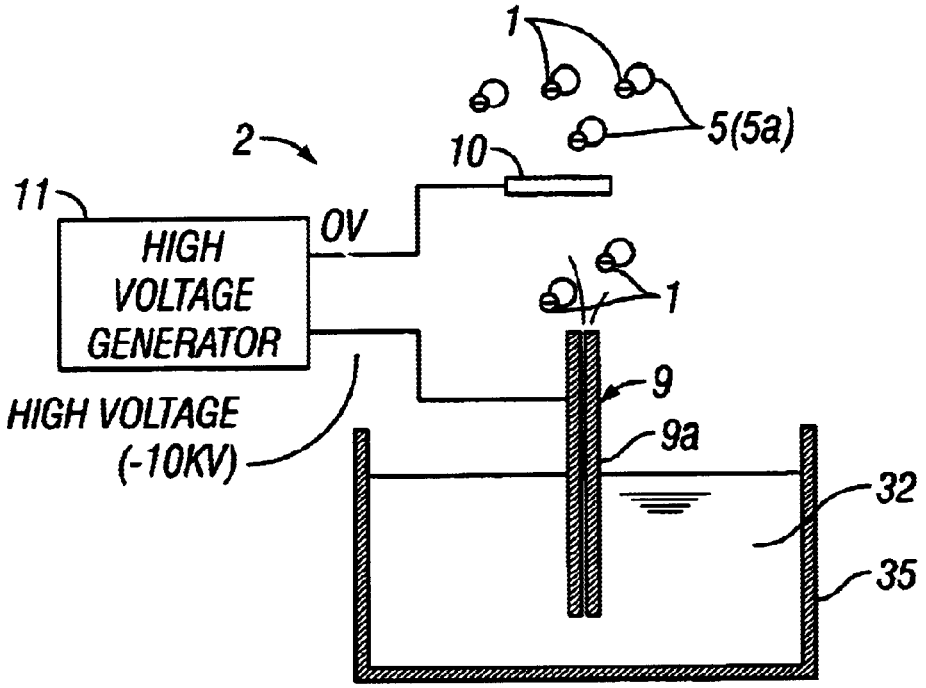
FIG. 16 is a schematic illustrating a mechanism that produces ionized particles.
Figure 17:
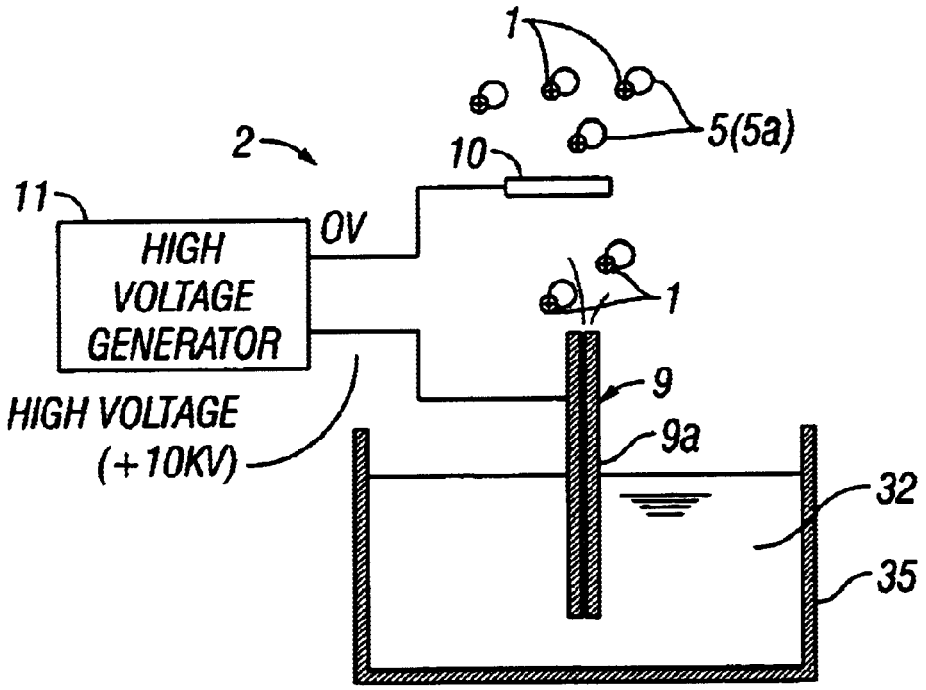
FIG. 17 is a schematic drawing illustrating a mechanism that produces ionized particles.
Figure 18:
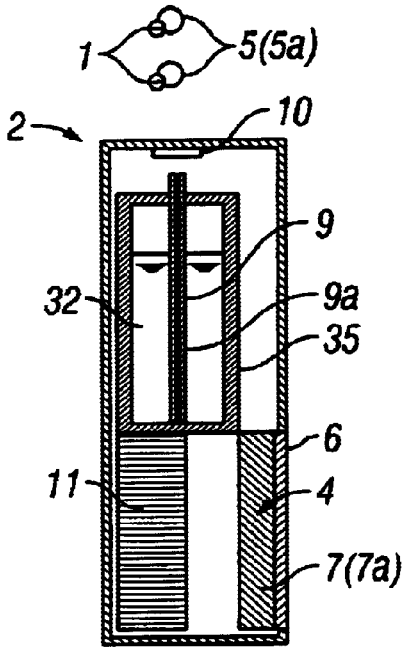
FIG. 18 is a cross-sectional drawing illustrating an ionized particle generator in accordance with one embodiment of the present invention.

FIGS. 16 through 18 show yet another embodiment of the ionized particle generator 2. In the present embodiment, compound particles comprising ionized particles 1 and other particles 5 are generated through subjecting a liquid medium 32 to a static electrical shower. In the present example, the needle-shaped discharge electrode 9 is structured from a long thin metal tube 9*a*. One end of the metal tube 9*a* is inserted into a container 35 that contains a solution 32 of a perfuming agent, a deodorizing agent, or the like, the tip of the metal tube 9*a* is caused to protrude from the vessel 35, and capillary action is used to supply the solution 32 to the tip of the metal tube 9*a*. As is shown in FIG. 16, if negatively charged compound particles are to be produced, a voltage of −10 kV DC relative to the ground electrode 10 is applied by the high voltage generator 11 to the metal tube 9*a* (the needle-shaped discharge electrode). When this is done, the electric field is concentrated at the tip of the metal tube 9*a*, causing, at the tip of the metal tube 9*a*, an electrostatic shower of the solution 32 from inside the metal tube 9*a*, generating compound particles of the negatively ionized air (ionized particles 1) and the solution 32. The result of continuously supplying the particles of the solution 32 to the tip of the metal tube 9*a* through capillary action on the inside of this metal tube 9*a* is that it is possible to produce these compound particles continuously. Conversely, if, as shown in FIG. 17, positively charged compound particles are to be produced, a voltage of +10 kV DC relative to the ground electrode 10 may be applied by the high voltage generator 11 to the metal tube 9*a* (the needle-shaped discharge electrode 9). When compound particles including the solution 32 are generated in this way, a great number of a variety of particles (solution particles, etc.) can be attracted by the object 3 and can be adsorbed continuously thereby, making it possible to provide the effects of the solution particles (a perfuming effect, deodorizing effect, etc.) to the object 3.

Figure 22:
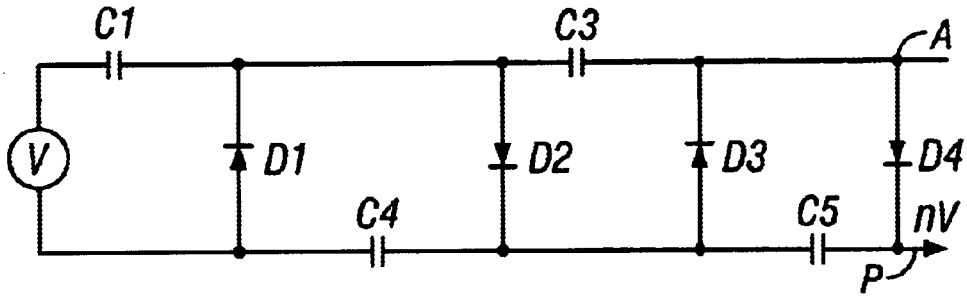
FIG. 22 shows a Cockcroft-Walton circuit that structures an embodiment of a high voltage generator.
Figure 23:
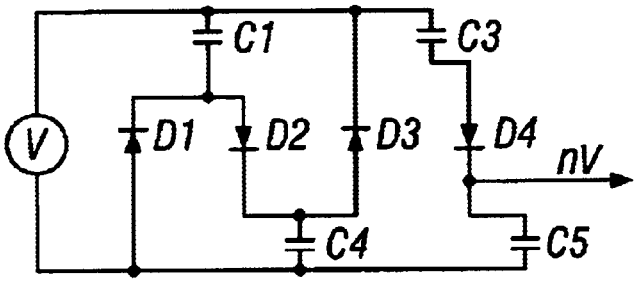
FIG. 23 shows a Schenkel circuit that structures one embodiment of a high voltage generator.
Figure 24:
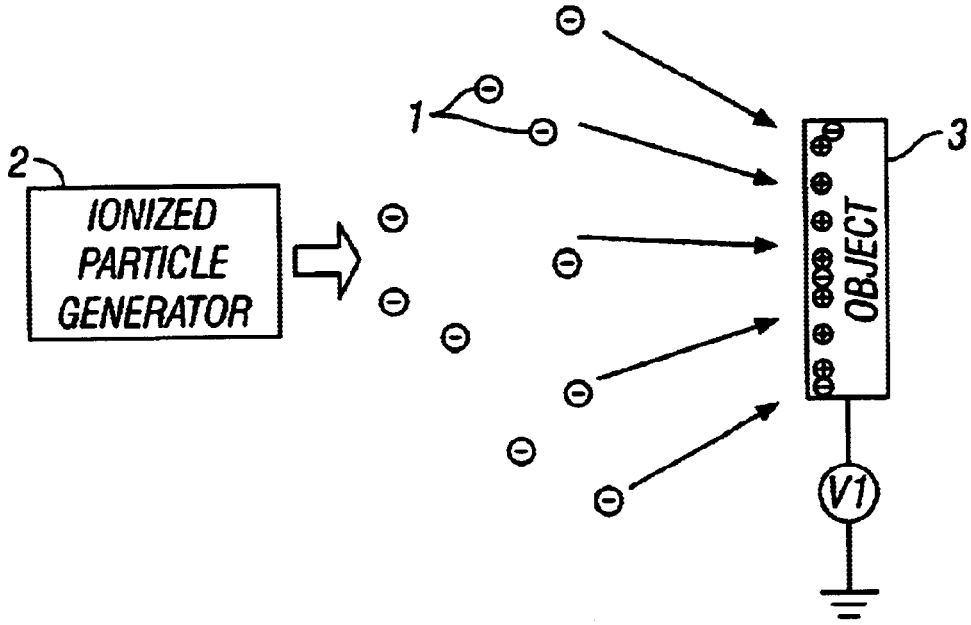
FIG. 24 (Prior Art)
FIG. 24 shows a prior art apparatus for applying ionized particles.
Figure 25:
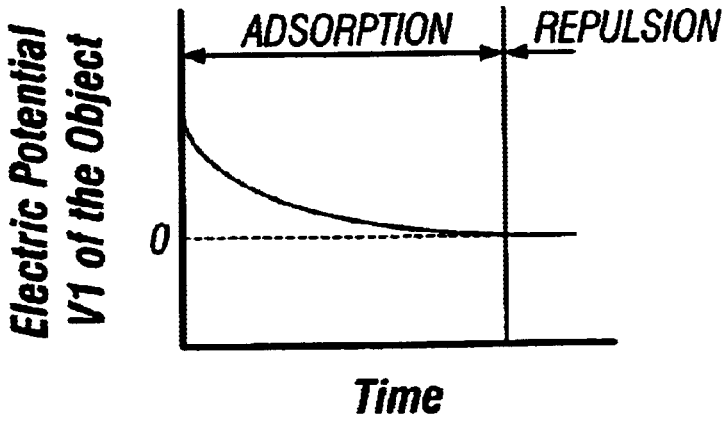
FIG. 25 is a graph showing the electric potential as a function of time for the object of FIG. 24.
Figure 26:
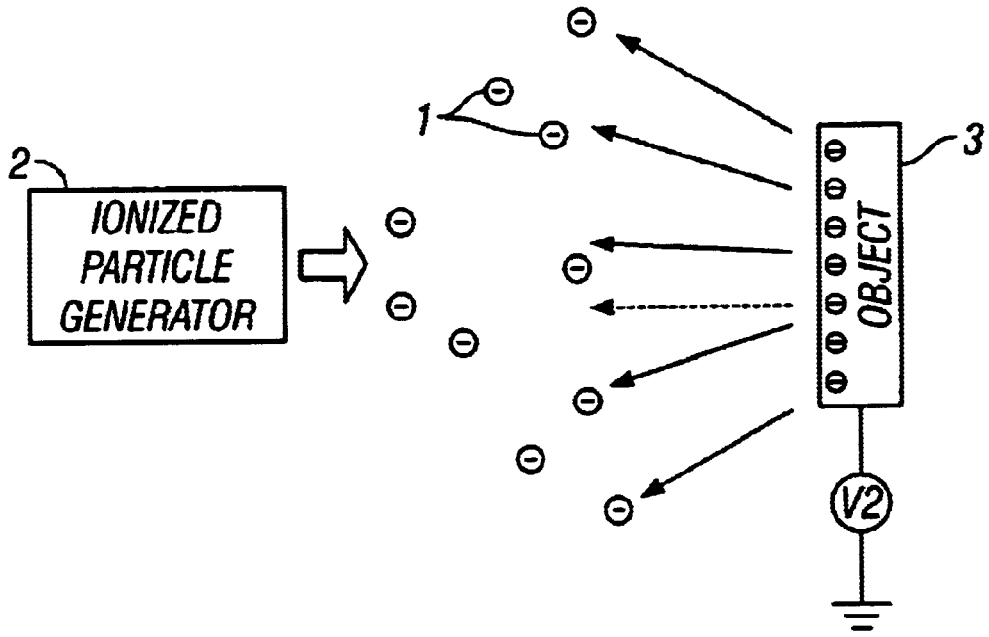
FIG. 26 (Prior Art)
FIG. 26 shows a prior art example wherein the negatively ionized particles are repelled from the object and thus cannot adhere.
Figure 27:
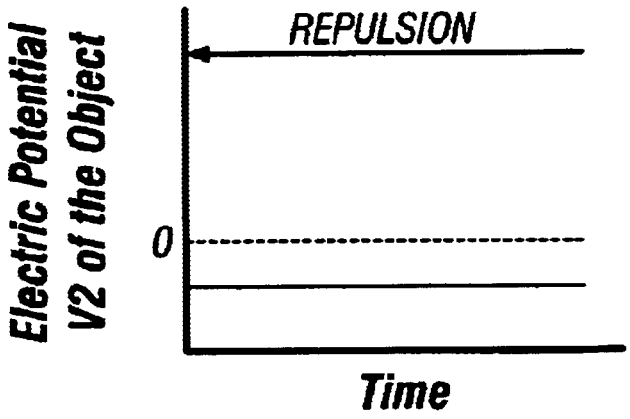
FIG. 27 is a graph showing the electric potential as a function of time for the object of FIG. 26.
Figure 28:
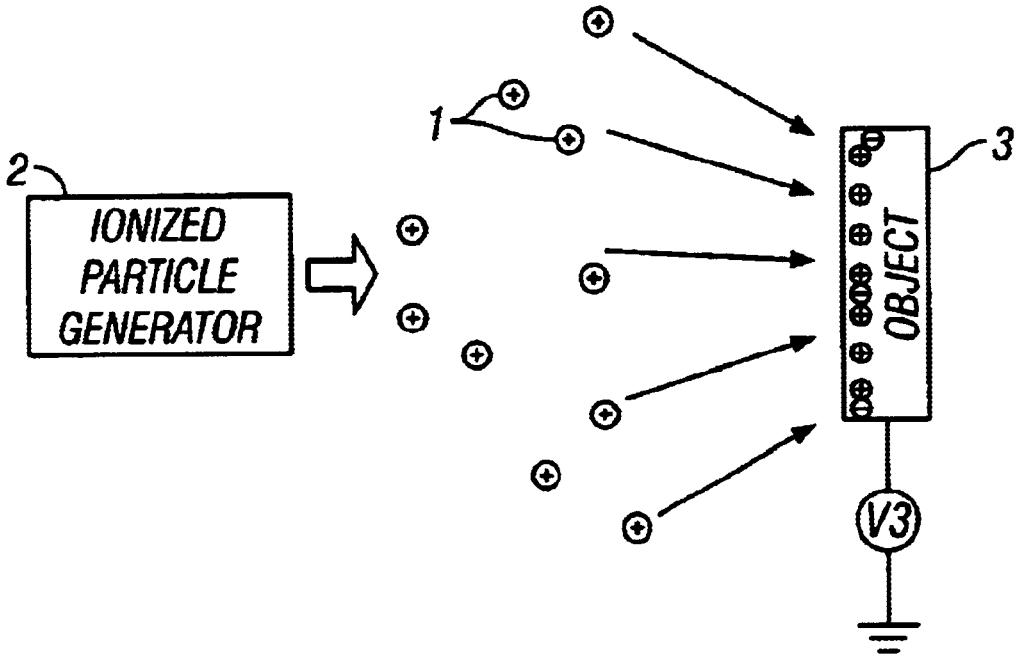
FIG. 28 (Prior Art)
FIG. 28 shows a prior art example wherein the ionized particles comprise positively ionized air and the object is charged to a negative electric potential.
Figure 29:
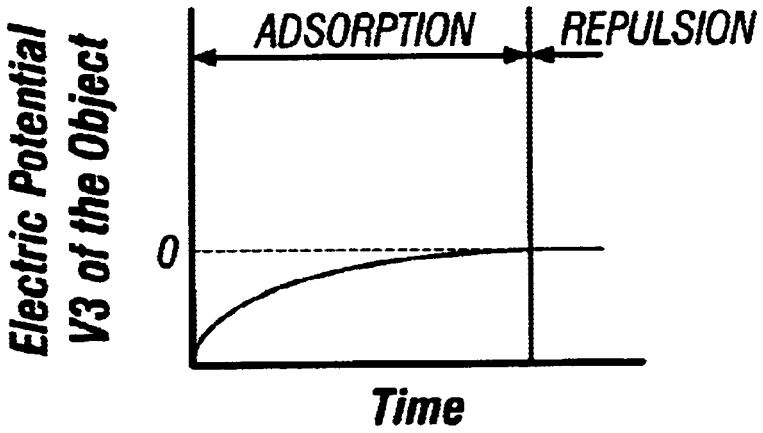
FIG. 29 is a graph showing the electric potential as a function of time for the object of FIG. 28.
Figure 30:
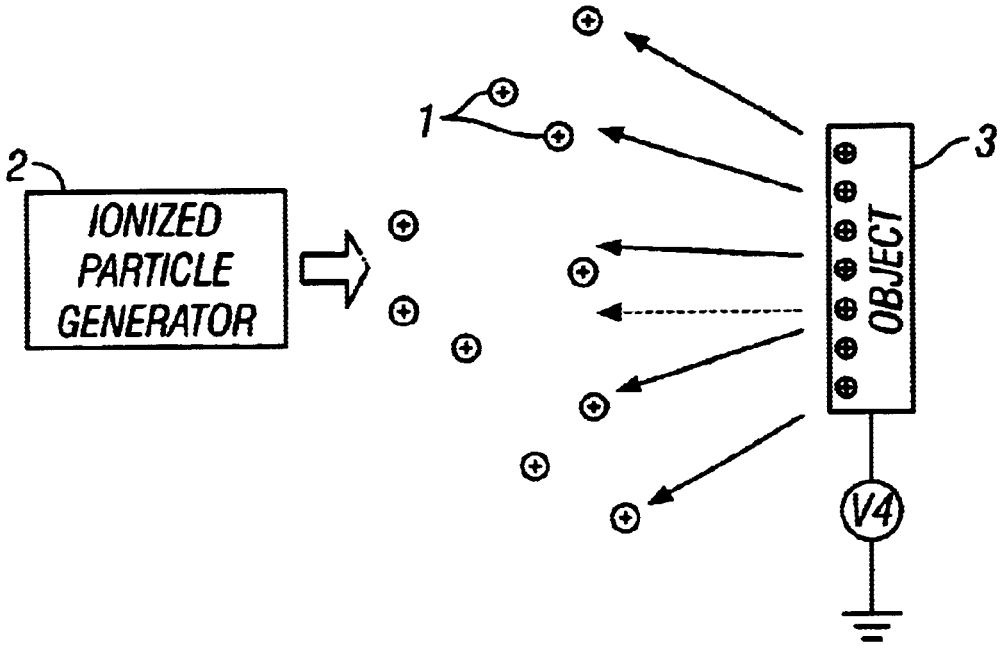
FIG. 30 (Prior Art)
FIG. 30 shows a prior art example wherein the positively ionized particles are repelled from the object and thus cannot adhere.
Figure 31:
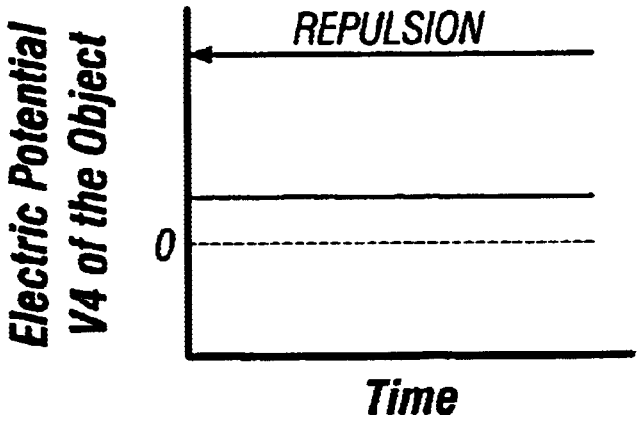
FIG. 31 is a graph showing the electric potential as a function of time for the object of FIG. 30.

FIGS. 22 and 23 show an example of an electronic circuit that structures the aforementioned high voltage generator 11. This electronic circuit is provided in order to maintain the object 3 at an electric potential that is has the opposite polarity of the charge on the ionized particles 1. FIG. 22 shows a Cockcroft-Walton circuit comprising a step-up capacitor group C1 to C5 and diode group D1 to D4 (switching elements), able to step up the voltage on the capacitors connected in series. For example, using a four-stage combination of capacitors and diodes, it is possible to generate a voltage of approximately 0.5 kV from an off-the-shelf power supply. Note that the output wire P should be attached at the point a in FIG. 22 if a negative voltage is to be generated. Conversely, instead of the Cockcroft-Walton circuit in FIG. 22, the Schenkel circuit shown in FIG. 23 may be used instead. The use of this type of electric circuit makes it possible to create the high voltage generation device 11 inexpensively. Additionally, because the electronic circuit is able to maintain the electric potential of the object 3 at a constant level, not only are the ionized particles 1 emitted towards the object 3, but an increased number of the ionized particles 1 are constantly attracted to the object 3 and are adsorbed continuously thereby.

Figure 19:
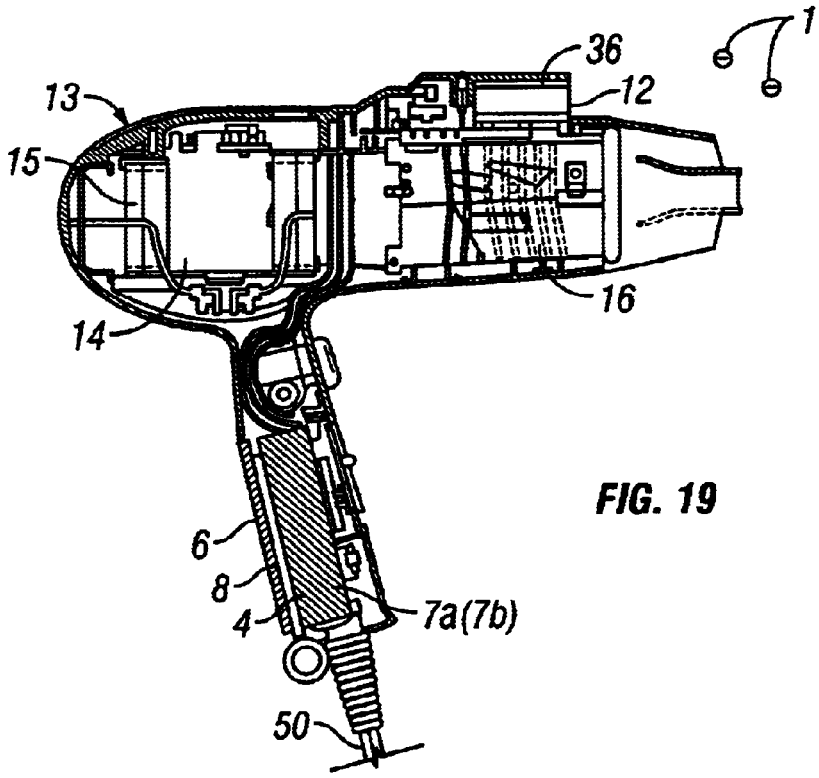
FIG. 19 is a cross-sectional drawing illustrating an embodiment wherein tourmaline is incorporated into the aforementioned hair dryer.

Other methods aside from electrical discharge can be used as the ionized particle generator 2 to generate the ionized particles 1. One such example is shown in FIG. 19. In this example, tourmaline 36 is built into the hair dryer 13 to generate the ionized particles 1. The inside of the blow tube of the hair dryer 13 is coated with tourmaline powder 36. The object 3 is the hair. When the hair dryer 13 is operated, the heat from a heater 16 increases the temperature within the blow tube. When this is done, the tourmaline 36 is heated, causing the tourmaline 36 to polarize into positive and negative sides, negatively ionizing the surrounding air, thereby generating negatively ionized air. This causes negatively ionized air to be discharged from the ionized particle blower 12 along with the hot air from the dryer outlet opening. Because it is possible to generate ionized particles 1 without using an electrical discharge, there will be no production of substances that can have a harmful effect on the human body, such as ozone, generated by electrical discharges. Furthermore, no electronic circuits are needed, making it possible to reduce the manufacturing cost.

Note that the non-electrodischarge ion supply method described above can be applied to hairbrushes as well as to the hair dryer described above. For example, negatively ionized air can be produced without using electrical discharges by mixing tourmaline powder into the hairbrush materials. In other words, because the bristles deform when the hair is brushed with the hairbrush, negatively ionized air is produced by the tourmaline 36, making it possible to generate the ionized particles 1 (negatively ionized air) without using electrical discharges.

A powder of a radioactive material (such as radium) can be coated onto the inside of the blow tube of the hair dryer instead of using the aforementioned tourmaline. Conversely, the powder of the radioactive materials can be mixed into the hair bush material. In either case, the radioactive material such as radium constantly emits $\alpha$ rays, where these $\alpha$ rays are minute positively-ionized particles (helium atoms which have lost two electrons). While passing through the air, these minute particles collide with air particles, ionizing the air and producing negatively ionized air as the ionized particles. This makes it possible to produce ionized particles (negatively ionized air) without using electrical discharges, and is advantageous in terms of cost as well.

Yet another example of the ionized particle generator 2 is that of generating the ionized particles 1 using the Lenard effect. For example, a shower of water may be used. In this case, a positive voltage generation circuit is contained within a showerhead (not shown). When water is expelled from the showerhead, the water comes in contact with, for example, the walls, and when the water strikes, for example, the wall and breaks up into tiny water droplets, the dissociated water droplets are positively charged and the surrounding air is negatively charged. At this time, ionized particles (negatively charged air) are generated. In this way, a large amount of negatively ionized air is emitted in the vicinity of the shower water due to the Lenard effect. This is the same phenomenon that creates a large amount of negatively ionized air in the vicinity of a waterfall. When the shower head is grasped when the shower is used, the human body (hair, scalp, skin, etc.) is charged to a positive electric potential by a positive voltage generation circuit, thereby causing the aforementioned negatively ionized air to continuously strike the hair, making the hair even more manageable and giving it more body. Note that the negatively ionized air is generated without using electrical discharges, as so there is no production of substances such as ozone, which is produced through electrical discharge, that can harm the human body 3*a*, and because electronic circuits are not required, the components can be produced inexpensively.

Figure 11A:
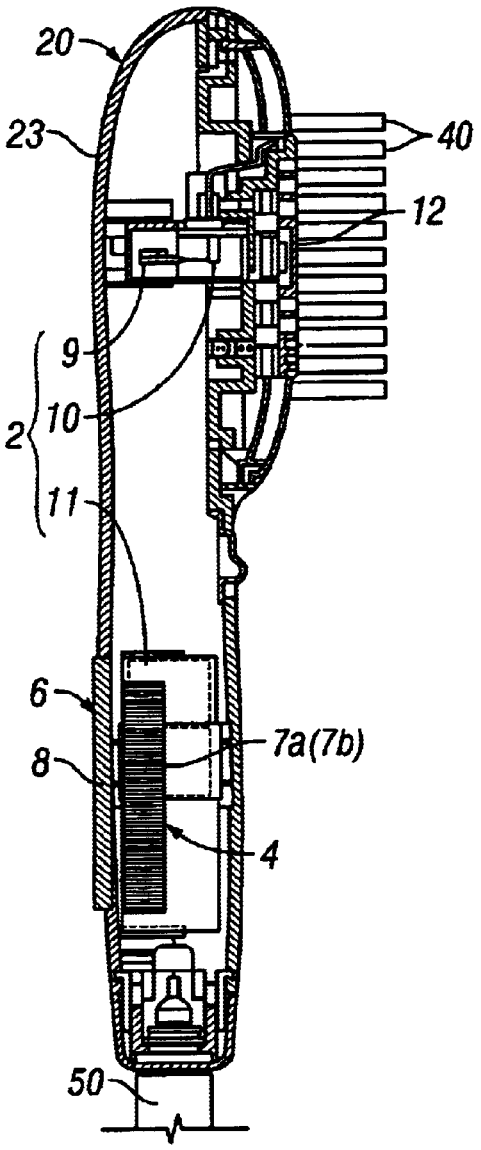
FIG. 11(*a*) shows a cross-sectional drawing where an apparatus for applying ionized particles is incorporated into a hairbrush, and FIG. 11(*b*) is an orthonormal view of the same.
Figure 11B:
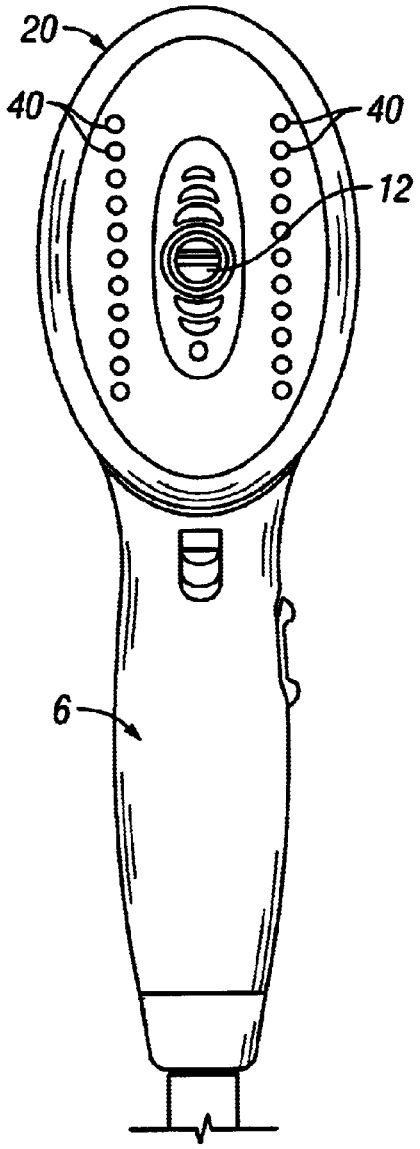

As yet another example of the means for maintaining electric potential 4, a voltage can be applied to the object 3 immediately before the charged particle 1 is adsorbed by the object 3. Once such example is shown in FIGS. 11(*a*) and (*b*). In this example, contact friction charging is used as the means for maintaining electric potential 4, and the hairbrush 20 is given as one example thereof. When the object 3 is a material that tends to cause friction charging easily (for example, when the object 3 is hair), the brush portion 40 is structured from material such as nylon as the means for maintaining the electric potential of the object 3. Note that the number of brushes 40, their shape, and their arrangement are not limited to the examples shown in FIG. 11. Note also that when human hair is brushed, the brushes 40 contact the hair and thus a frictional charging occurs between the brush portion 40 and the hair, where the hair is charged positively and the brush portion 40 is charged negatively. When the ionized particle blower 12 is applied to the positively charged hair, the negatively ionized air is attracted to the hair, and can be adsorbed continuously thereby, making it possible to obtain an effect of making the hair even more manageable and giving it even more body. In other words, because a greater number of the ionized particles 1 are attracted to and are adsorbed continuously by the object 3 when the ionized particles 1 are emitted towards the object 3, this functions efficiently. Additionally, because no electronic circuitry is required to use this contact friction charging, the manufacturing can be done expensively.

Figure 20:
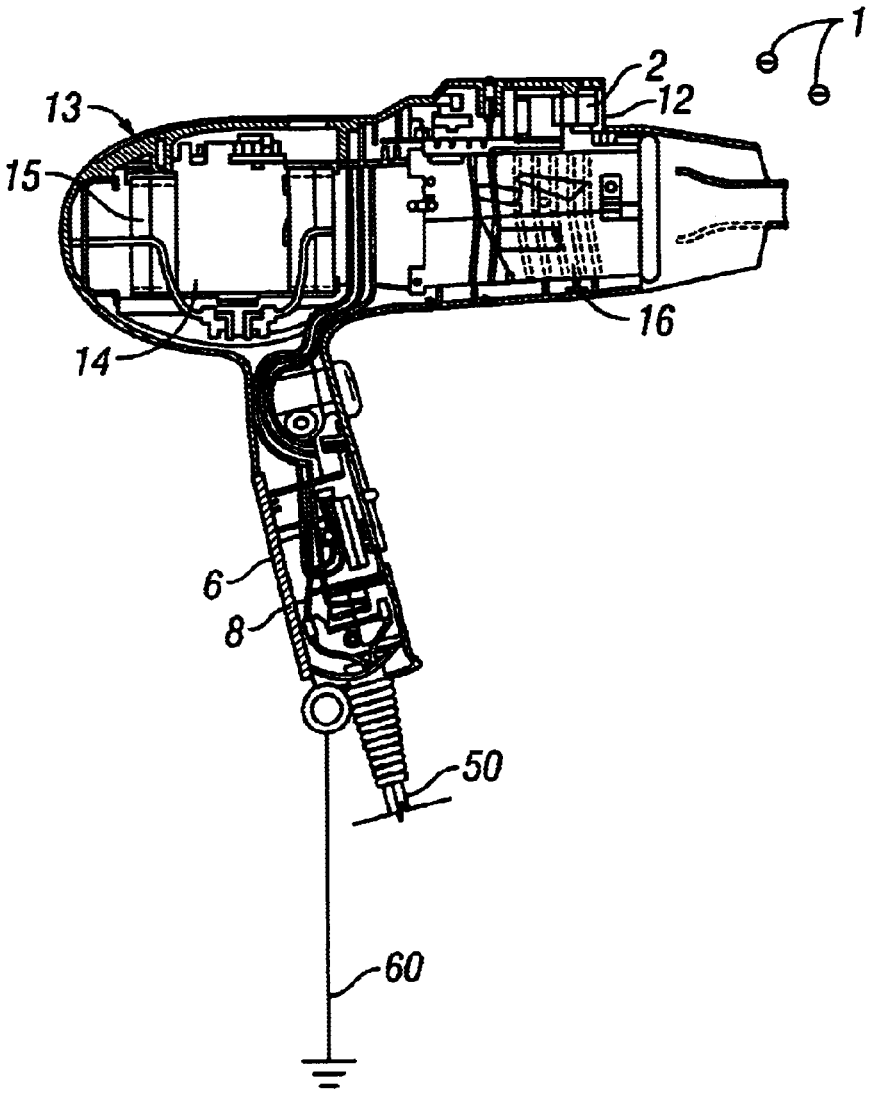
FIG. 20 is a cross-sectional diagram illustrating an embodiment wherein a ground wire is connected to the grip member of the aforementioned hair dryer.

FIG. 20 shows the case wherein the object 3 is connected to a ground wire 60 as another example of a means for maintaining electric potential 4. When the object 3, to which the ionized particles 1 are to be attracted and adsorbed, is connected to a ground wire 60, the electric potential of the object 3 is always held at 0V. When, for example, the object 3 is a human body 3*a* (FIG. 6), the hand is grounded when it is in contact with the grip member 6, causing the entire human body 3*a* (the hair, scalp, skin, etc.) to go to 0V. When the object 3 is at 0V, the ionized particles 1 are attracted to and are adsorbed by the object 3. After the ionized particles 1 are adsorbed by the object 3, the charge on the ionized particles 1 flows to the outside through the ground wire 60. Because of this, the object 3 is maintained at the 0V electric potential, making it possible for the ionized particles 1 to continue to strike the object 3. Because the ground wire 60 is used as the means for allowing the charge on the object 3 to escape, the structure is simple and can be executed inexpensively.

Even in the case wherein the polarity of the electric potential on the object 3 is the same as the electric potential on the ionized particles 1 (in yet another example embodiment of the means for maintaining electric potential 4), the electric potential of the object 3 can be maintained at a lower level than the electric potential of the ionized particles 1. Here a case will be explained wherein the charge that adheres to the object 3 diffuses as the means for maintaining the electric potential of the object 3. When negatively ionized air adheres to the object 3 (such as hair), the hair becomes negatively charged, preventing the negatively charged air from striking the hair. When the particularly extreme parts of the hair are negatively charged, it will not feel as though the hair as a whole is manageable or has body. Given this, a substance with low resistivity (i.e. an electrically conductive substance) is applied to the object 3 in this example. If, for example, the object 3 is hair, then if water is used as the low-resistivity substance, then the hair as a whole is wetted through the application of water. This causes the negative charge to diffuse through the water throughout the hair as a whole, making it possible for the negatively ionized air to continue to strike the hair. Consequently, even if the electric potential on the object 3 has the same polarity as the electric potential of the ionized particles 1, the diffusion of the charge in the object 3 can maintain the electric potential at the object 3 at an electric potential that is lower than that of the ionized particles 1, with the result that the ionized particles 1 will be attracted to the object 3 and can be adsorbed continuously thereto. This is also the case for when the ionized particles 1 are positively charged.

Note that even though the explanation above was for a case wherein the charge on the object 3 was diffused through the use of water, other materials aside from water can, of course, be used instead. When the electric potential of the object 3 is the same polarity as the charge on the ionized particles 1, the voltage level generated by the voltage generator circuit can, for example, be reduced as the means for maintaining the electric potential of the object 3 at a level that is lower than the electric potential of the ionized particles 1. Essentially, all that must be done is to reduce the electric potential level to the degree that the ionized particles 1 are attracted and adsorbed (rather than being repelled).

As yet another example of the means for maintaining electric potential 4, the charging of the hair by the ionized particles 1 can be neutralized by ionized particles 1 of the opposite polarity. In this example, a case will be explained wherein both a high voltage generator for generating positively ionized air and a high voltage generator for generating negatively ionized air are used, where a switching circuit is used to switch between the outputs of these two high voltage generators at given time intervals. First the high voltage generator for generating negatively ionized air is used to cause the emission of negatively ionized air over a specific period of time, at which time the hair is charged by the negatively ionized air. After the specific period of time has elapsed, the switching circuit switches to the high voltage generator for generating positively ionized air, and the positively ionized air is emitted for a specific period of time. Doing this causes the negatively ionized air, which has charged the hair, to be neutralized by the positively ionized air, eliminating the negatively ionized air from the hair. After another specific period of time has elapsed, the switching circuit switches to the high voltage generator for generating negatively ionized air. Because the negatively ionized air has been eliminated from the hair, the negatively ionized air is attracted readily to the positively charged hair, facilitating further adsorption. Alternating the polarity of the ionized particles in this way can increase the effects of making the hair manageable and giving the hair body. Because the charging of the object can be neutralized without an external connection, this approach can be used on objects to which ground lines cannot be connected (such as hair dryers, hairbrushes, etc.).

Although the hair dryer 13, the hairbrush 20, the skin care device 21, and the steam generator device 27 were given as examples of application of the apparatus for applying ionized particles of the present invention, the present invention is not limited thereto, and can be used in a broad variety of applications such as, for example, electric toothbrushes.

According to one embodiment of the present invention, a ionized particle generator that emits ionized particles in the direction of the object, and an means for maintaining electric potential for maintaining the electric potential of the object so that the ionized particles will be attracted to and adsorbed by the object continuously are provided, thus making it possible to maintain indefinitely an electric potential on the object with the opposite polarity of the electric potential of the ionized particles using the means for maintaining electric potential, which makes it possible for the ionized particles from the ionized particle generator to continue to strike the object, making it possible for the object to attract more of the ionized particles, and also making it possible for the object to continuously adsorb the ionized particles. Consequently, the substance that is formed into the ionized particles will act continuously on the object (i.e., will be adsorbed continuously by the object), providing an effect where the hair will become manageable and will have body (assuming a case where, for example, the object is hair and the ionized particles are negatively ionized air).

According to one example of embodiment of the present invention, the ionized particle generator generates ionized particles through electrical discharge, and thus it is possible to generate a larger number of ionized particles, thus having the effect of causing a greater number of ionized particles to be attracted to, and to be adsorbed continuously by, the object. The result is that when, for example, the object is hair and the ionized particles are negatively ionized air, a greater amount of the negatively ionized air is adsorbed by the hair, increasing the effects of making the hair manageable and giving the hair body.

According to one embodiment of the present invention, the ionized particle generator causes the ions that are generated by an electric discharge to adhere to other particles, which are then emitted, making it possible to form ionized particles with particles other than air particles. This makes it possible to cause a large number of a broad variety of particles to be attracted to, and to be continuously adsorbed by, the object, making it possible to provide the various benefits and effects of the other particles on the object.

According to one embodiment of the present invention, the ionized particle generator generates ionized particles using the Lenard effect, and thus none of the substances such as ozone that can have a negative effect on the human body will be produced as a result of using electrical discharge, and because no electronic circuitry is required, manufacturing can be performed inexpensively.

The means for maintaining electric potential according to one embodiment of the present invention maintains the electric potential of the object at an electric potential with a polarity that is opposite of the charge on the ionized particles, making it possible for a greater number of the ionized particles to be attracted to, and continuously adsorbed by, the object rather than the ionized particles merely being emitted in the direction of the object.

According to one embodiment of the present invention, the means for maintaining electric potential maintains the electric potential of the object at a level that is lower than the electric potential of the ionized particles in a situation wherein the electric potential of the object is of the same polarity as the charge on the ionized particles, thus making it possible to cause the ionized particles to be attracted to the object and to be adsorbed continuously by the object by merely reducing the electrical potential of the object below that of the electric potential of the ionized particles, without having to switch the polarity of the electric potential of the object to be opposite of that of the charge on the ionized particles, even in the case wherein the electric potential of the object is the same polarity as the charge on the ionized particles.

According to one example embodiment of the present invention, the means for maintaining electric potential applies a voltage to the object immediately before the ionized particles are adsorbed by the object, thus making it possible to attract a larger number of ionized particles and continuously adsorb the ionized particles only when the ionized particles are emitted towards the object, thus allowing efficient operation.

According to one embodiment of the present invention, the aforementioned ionized particle generator and the aforementioned means for maintaining electric potential are incorporated into a hair dryer, where not only does the means for maintaining electric potential charge the grip member of the hair dryer, but also an ionized particle blower is equipped in the blow tube of the hair dryer, thus charging the entire human body (hair, scalp, skin, etc.) to a positive (or negative) electric potential when the hair dryer grip member is grasped. This creates an electric power beam directed at the human body, causing the ionized particles to follow the electric power beam, where they are attracted to, and adsorbed by, the human body (the hair), while the electric potential of the charged human body is maintained without change by the means for maintaining electric potential so that the ionized particles can be continue to strike the human body (the hair). Consequently, not only is it possible to add to the hair dryer functions the function of emitting ionized particles at the object, but also functions that are able to cause a greater number of ionized particles to be attracted to, and to be adsorbed continuously by, the object.

According to one embodiment of the present invention, the aforementioned ionized particle generator and the aforementioned means for maintaining electric potential are incorporated into a hairbrush, where not only is the grip member of the hairbrush charged by the means for maintaining the electric potential, but where the ionized particle blower is disposed on the front surface of the brush portion, thus charging the entire human body (hair, scalp, skin, etc.) to a positive (or negative) electric potential when the grip member of the hairbrush is grasped by the hand of the user. Because this creates an electric power beam directed at the human body, the ionized particles move along this electric power beam, not only causing the ionized particles to be attracted to, and adsorbed by, the human body (the hair), but also causing the means for maintaining electric potential to maintain the electric potential of the human body without change, thus making it possible for the ionized particles to strike the human body (hair) continuously. Consequently, not only is it possible to add to the hairbrush functions for emitting ionized particles towards an object, but also to add functions that make it possible for the human body to attract a greater number of ionized particles and to adsorb the ionized particles continuously.

According to one embodiment of the present invention, the aforementioned ionized particle generator and the aforementioned means for maintaining electric potential are incorporated into a steam generator device, where not only is the grip member that is equipped in the steam generator device charged by the means for maintaining electric potential, but an ionized particle blower is disposed in the vicinity of the steam outlet opening, thereby causing the human body as a whole (the hair, scalp, skin, etc.) to be charged to a positive (or negative) electric potential when the grip member is grasped by the hand, where, when the steam that is expelled from the steam outlet opening in this state strikes the skin, the negatively charged air from the ionized particle blower is continuously attracted by, and adsorbed by, the skin. Consequently, when the negatively ionized air is applied to the skin for which the moisture content is to be increased by the steam from the steam generator, there is an effect of maintaining the moisture in the skin, etc., making the skin supple and soft. Even when the steam is sprayed inside the oral cavity, a greater amount of the negatively charged air is adsorbed by the mucus membrane in the throat, making it possible to obtain an effect wherein the moisture in the mucus membrane is increased. As a result, it is possible to add to the functions of the steam generator device not only the emission of charged particles towards the object, but also functions that are able to cause a greater number of the charged particles to be attracted to, and adsorbed continuously by, the object.

According to an embodiment of the present invention, the means for maintaining electric potential is provided with a voltage generator circuit that charges the grip member, thus making it easy to charge the grip member with an electric charge that is of the opposite polarity from the charge on the charged particles, doing so using a positive voltage generator circuit or a negative voltage generator circuit.

According to one embodiment of the present invention, the aforementioned voltage generator circuit charges the grip member through an insulating material, thus making it possible to prevent the danger of electric shock, etc., when the object is a human body. This is because the contact is through an insulator when charging the human body.

According to one embodiment of the present invention, not only are the charged particles from the ionized particle generator emitted towards the object, the electric potential of the object is maintained so as to make it possible for the charged particles to be continuously attracted to, and adsorbed by, the object, and thus it is possible to not only emit charged particles towards the object, but also possible to cause a greater number of charged particles to be attracted to, and adsorbed by, the object.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A hairdryer comprising:

a housing body having an air intake opening and an air outlet opening;

an air ionizing device disposed within the housing body for generating ionized air charged in either positive or negative polarity;

a fan disposed within the housing body for introducing air into the housing body through the air intake opening and directing the air to the air ionizing device such that the air containing ionized air is discharged through the air outlet opening;

a handle attached to the housing body; and a voltage generator, electrically connected to the handle, disposed within the housing body for generating a predetermined voltage to cause a user grasping the handle to electrically charge in the other polarity opposite to the polarity of the ionized air.

2. The hairdryer according to claim 1, wherein the voltage generator and the handle is connected via an insulating member.

3. A hair brush comprising:

a main body having a grip portion and a brush portion, wherein the grip portion is provided with an a intake opening and the brush portion is provided with an air outlet opening;

an air ionizing device disposed within the main body for generating ionized air charged in either positive or negative polarity;

a fan disposed within the am body for introducing air into the main body through the air intake opening an directing the air to the air ionizing device such that the air containing ionized air is discharged through the air outlet opening; and a voltage generator; electrically connected to the handle, disposed within the main body for generating a predetermined voltage to cause a user grasping the grip portion to electrically charge in the other polarity opposite to the polarity of the ionized air.

4. The hair brush according to claim 3, wherein the voltage generator and the grip portion is connected via an insulating member.

5. A steam applicator comprising:

a housing body having a steam outlet opening, a steam generator dispose in the housing body for generating steam;

an air ionizing device disposed within the housing body for generating ionized air charged in either positive or negative polarity;

a fan disposed within the housing body for expelling steam generated by the steam generator toward the air ionizing device such that the steam containing ionized air is discharged through the steam outlet opening;

a grip member attached to the housing body; and a voltage generator, electrically connected to the grip member, disposed in the housing body for generating a predetermined voltage to cause a use grasping the grip member to electrically charge in the other polarity opposite to the polarity of the ionized air.

6. The hair brush according to claim 5, wherein the voltage generator and the grip member is connected via an insulating member.

* * * * *

UNITED STATES PATENT AND TRADEMARK OFFICE

CERTIFICATE OF CORRECTION

PATENT NO. : 6,763,606 B2
DATED : July 20, 2004
INVENTOR(S) : Itaru Saida

It is certified that error appears in the above-identified patent and that said Letters Patent is hereby corrected as shown below:

Column 16,
Line 15, please replace the word “a” with -- air-- in between the words “an” and “intake”.
Line 21, please replace the word “am” with -- main -- in between the words “the” and “body”.
Line 22, please replace the word “an” with -- and -- in between the words “opening” and “directing”.
Line 26, please replace the “semicolon” with a -- comma -- in between the words “generator” and “electrically”.
Line 36, please replace the word “dispose” with -- disposed -- in between the words “generator” and “in”.

Signed and Sealed this

Fifth Day of April, 2005

JON W. DUDAS
*Director of the United States Patent and Trademark Office*